US009895045B2

(12) United States Patent
Carlson et al.

(10) Patent No.: US 9,895,045 B2
(45) Date of Patent: Feb. 20, 2018

(54) DISHWASHER HAVING SPRAY MANIFOLD

(71) Applicant: WHIRLPOOL CORPORATION, Benton Harbor, MI (US)

(72) Inventors: Christopher J. Carlson, Watervliet, MI (US); Jordan R. Fountain, Millbrae, CA (US); Antony M. Rappette, Benton Harbor, MI (US); Chad T. Vanderroest, Covert, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 45 days.

(21) Appl. No.: 14/807,928

(22) Filed: Jul. 24, 2015

(65) Prior Publication Data

US 2015/0327747 A1 Nov. 19, 2015

Related U.S. Application Data

(62) Division of application No. 13/274,414, filed on Oct. 17, 2011, now Pat. No. 9,119,517.

(51) Int. Cl.

| | |
|---|---|
| ***B08B 3/00*** | (2006.01) |
| ***A47L 15/16*** | (2006.01) |
| ***A47L 15/42*** | (2006.01) |
| ***A47L 15/22*** | (2006.01) |

(52) U.S. Cl.

CPC ..... *A47L 15/16* (2013.01); *A47L 15/22* (2013.01); *A47L 15/428* (2013.01); *A47L 15/4217* (2013.01); *A47L 15/4219* (2013.01); *A47L 15/4282* (2013.01); *A47L 2501/03* (2013.01)

(58) Field of Classification Search

CPC .... A47L 15/16; A47L 15/4219; A47L 15/428; A47L 15/22; A47L 15/4217; A47L 15/4282; A47L 2501/03

USPC ..... 198/198, 172; 134/198, 172

See application file for complete search history.

(56) References Cited

U.S. PATENT DOCUMENTS 7,331,356 B2 * 2/2008 VanderRoest ..... A47L 15/16 134/177

FOREIGN PATENT DOCUMENTS

DE 102006012453 A 10/2006
DE 102012217566 A1 3/2013

OTHER PUBLICATIONS

European Search Report for Corresponding EP15151651.5, dated Jun. 1, 2015.

* cited by examiner

*Primary Examiner* — Eric Golightly
(74) *Attorney, Agent, or Firm* — McGarry Bair PC

(57) ABSTRACT

A dishwasher includes a tub at least partially forming a treating chamber, a dish rack provided within the wash chamber, and a spray manifold. The spray manifold can have multiple apertures and/or sprayers for emitting wash liquid to define a spray zone.

16 Claims, 21 Drawing Sheets

DISHWASHER HAVING SPRAY MANIFOLD

CROSS-REFERENCE TO RELATED APPLICATION

This application is a division of U.S. patent Ser. No. 13/274,414, filed Oct. 17, 2011, now U.S. Pat. No. 9,119,517 issued Sep. 1, 2015, which is incorporated herein by reference in its entirety.

BACKGROUND OF THE INVENTION

Field of the Invention

The present invention relates to a dishwasher and more particularly to a dishwasher having multiple wash zones including an intensified wash zone for cleaning heavily soiled dishes.

Background

Modern dishwashers include a tub and an upper and lower rack or basket for supporting soiled dishes within the tub. A pump is provided for re-circulating wash liquid throughout the tub to remove soils from the dishes. Typically, larger dishes such as casserole dishes which have a propensity to be heavily soiled are carried on the lower rack and lighter soiled dishes such as cups and glasses are provided on an upper rack. The racks are generally configured to be moveable in or out of the tub for loading and unloading.

One of the problems associated with the typical modern dishwasher is that the dishes receive somewhat uniform wash treatment no matter their positioning within a rack in the dishwasher. For example, in a typical dishwasher, a lower wash arm rotates about a vertical axis and is provided beneath the lower rack for cleaning the dishes on the lower rack and an upper wash arm is provided beneath the upper rack for cleaning the dishes on the upper rack. Dishes in the upper rack receive somewhat uniform wash treatment and dishes in the lower rack receive somewhat uniform wash treatment. Accordingly, lightly soiled dishes in either dish rack are subject to the same wash performance as the highly soiled dishes in the same wash rack, which can lead to poor wash performance of the highly soiled dishes. As a result, it would be advantageous to provide a dishwasher with a second or concentrated wash zone for washing larger dishes such as the casserole dishes, which are more likely to be heavily soiled.

Another problem associated with the modern dishwasher is that to achieve optimal wash performance of heavily soiled, larger dishes, the dishes may need to be loaded with the surface that needs to be washed face down. The face down approach allows the lower spray arm to reach the heavily soiled surface. Accordingly, it would be advantageous if the dishwasher could be provided with a second wash zone that allowed the heavily soiled dishes to be loaded in an upright position, thereby optimizing the number of dishes that can be loaded in the dishwasher on any given cycle. Finally, it would also be advantageous if the dishwasher allowed for a customized wash cycle option which optimized the use of the second wash zone.

SUMMARY OF THE INVENTION

The invention relates to a dishwasher having a tub at least partially forming a treating chamber, a dish rack provided within the wash chamber, and a spray manifold.

In one aspect of the invention, the spray manifold has multiple apertures, multiple branches, a liquid distribution header defining an interior flow path having an inlet from which extends multiple channels corresponding to the multiple branches, with each of the channels in fluid communication with the corresponding branch, and a supply conduit in fluid communication with the inlet for supplying wash liquid to the liquid distribution header, wherein the corresponding channel and branch have matching volumetric flow rate requirements to minimize pressure loss from the inlet to the branches.

In another aspect of the invention, the spray manifold has first and second rotating spray heads, and first and second second interior flow paths that supply liquid to the rotating spray heads, wherein the first and second interior flow paths are configured to supply liquid to the first and second rotating spray heads, respectively, at the same volumetric flow rate.

In yet another aspect of the invention, the spray manifold has multiple rotating spray heads, each spray head having at least one aperture, and multiple liquid flow paths, each flow path corresponding to a rotating spray head, with each flow path supplying liquid at the same volumetric flow rate to the corresponding rotating spray head.

Still other aspects of the present invention will become apparent to those skilled in the art from the following detailed description, which is simply by way of illustration several of the best modes contemplated for carrying out the invention. As will be realized, the invention is capable of other different obvious aspects, all without departing from the invention. Accordingly, the drawings and descriptions are illustrative in nature and not restrictive.

BRIEF DESCRIPTION OF THE DRAWINGS

The accompanying drawings, incorporated in and forming part of the specification, illustrate several aspects of the present invention and together with their description serve to explain the principles of the invention. In the drawings.

DETAILED DESCRIPTION

Figure 1:
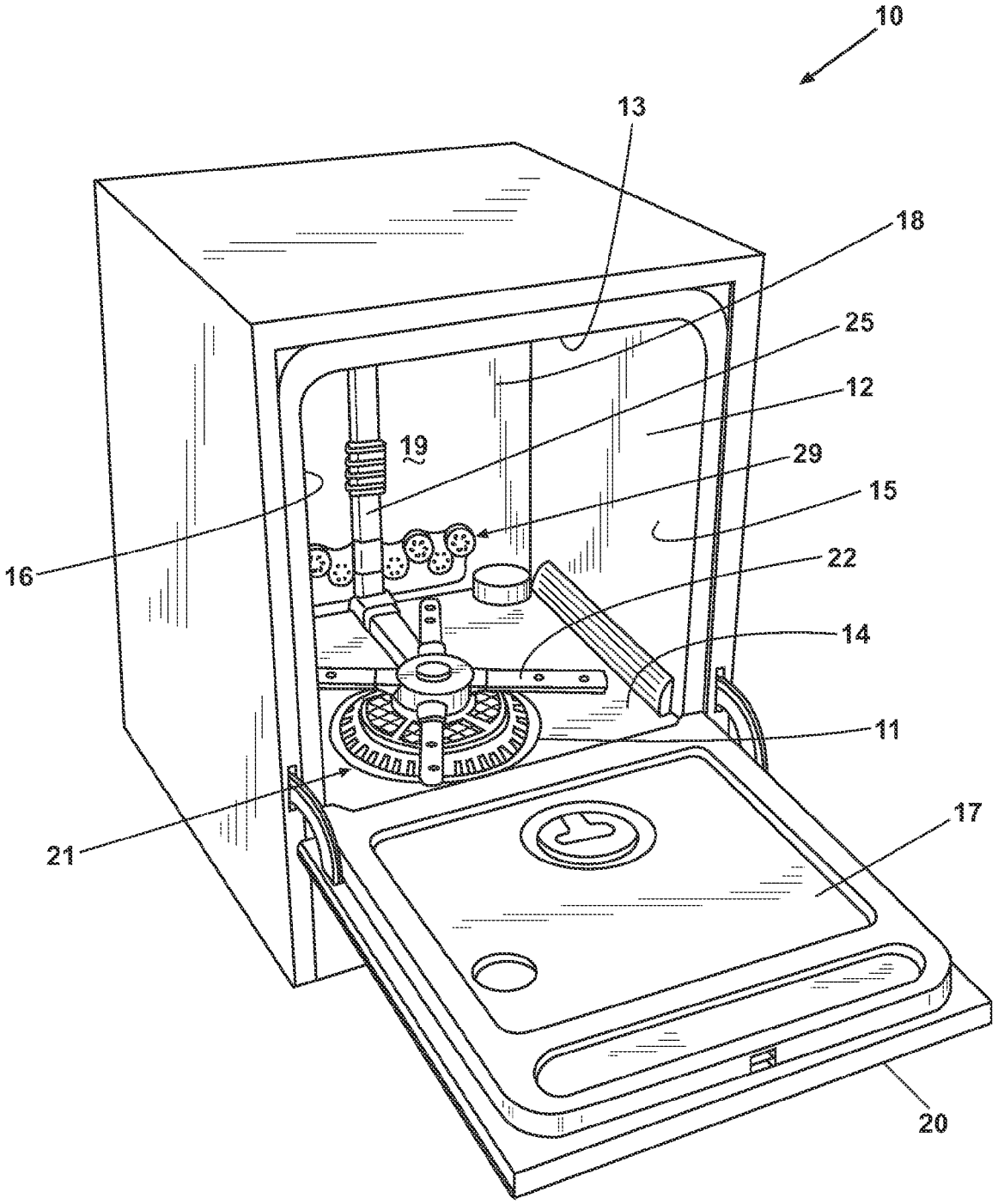
FIG. 1 is a perspective view of a dishwasher having multiple wash zones in accordance with a first embodiment of the present invention.
Figure 2:
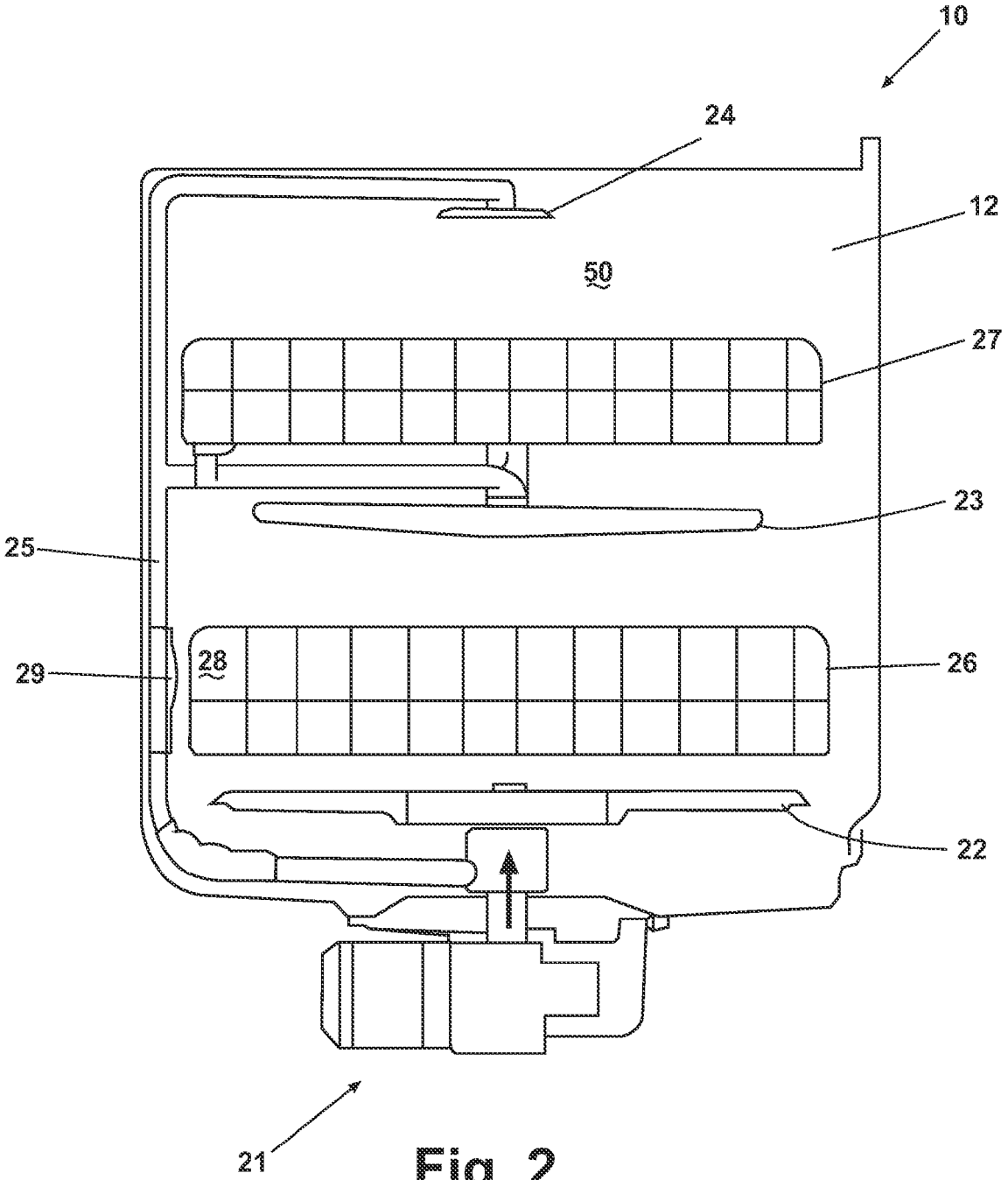
FIG. 2 is a schematic, cross-sectional view of the dishwasher shown in FIG. 1, showing the dish racks mounted in the tub, upper and lower spray arm assemblies and a spray manifold as contemplated by the present invention.

Referring now to the drawings in detail, wherein like numerals indicate the same elements throughout the views, FIGS. 1 and 2 illustrate an exemplary embodiment of a multiple wash zone dishwasher 10 in accordance with the present invention. In the embodiment shown generally in FIGS. 1 and 2, the dishwasher generally designated as 10 includes an interior tub 12 having a top wall 13, bottom wall 14, two side walls 15 and 16, a front wall 17 and a rear wall 18, which form an interior wash chamber or dishwashing space 19 for washing dishes. As one of skill in the art will appreciate, the front wall 17 may be the interior of door 20, which may be pivotally attached to the dishwasher for providing accessibility to the dishwashing space 19 for loading and unloading dishes or other washable items. While the present invention is described in terms of a conventional dishwashing unit as illustrated in FIG. 1, it could also be implemented in other types of dishwashing units such as in-sink dishwashers or drawer dishwashers.

The bottom wall 14 of the dishwasher may be sloped to define a lower tub region or sump 11 of the tub 12. A pump assembly 21 may be located in or around a portion of the bottom wall 14 and in fluid communication with the sump 11 to draw wash liquid from the sump 11 and to pump the liquid to at least a lower spray arm assembly 22. If the dishwasher has a mid-level spray arm assembly 23 and/or an upper spray arm assembly 24, liquid may be selectively pumped through a supply tube 25 to each of the assemblies for selective washing. As shown in FIG. 2, the supply tube 25 extends generally rearwardly from the pump assembly 21 to the rear wall 18 of the tub 12 and extends upwardly to supply wash liquid to either or both of the mid-level and upper spray arm assemblies 23, 24.

In the exemplary embodiment, the lower spray arm assembly 22 is positioned beneath a lower dish rack 26, the mid-level spray arm assembly 23 is positioned between an upper dish rack 27 and the lower dish rack 26, and the upper spray arm assembly 24 is positioned above the upper dish rack 27. As is typical in a conventional dishwasher, the lower spray arm assembly 22 is configured to rotate in the tub 12 and spray a flow of wash liquid, in a generally upward direction, over a portion of the interior of the tub 12. The spray from the lower spray arm assembly 22 is typically directed to providing wash liquid for dishes located in the lower dish rack 26. Like the lower spray arm assembly 22, the mid-level spray arm assembly 23 may also be configured to rotate in the dishwasher 10 and spray a flow of wash liquid, in a generally upward direction, over a portion of the interior of the tub 12. In this case, the spray from the mid-level spray arm assembly 23 is directed to dishes in the upper dish rack 27. Typically, the upper spray arm assembly 24 generally directs a spray of wash liquid in a generally downward direction and helps wash dishes on both the upper and lower dish racks 26, 27. The spray of wash liquid from any one of these spray arm assemblies 22, 23, 24 or from all three in combination is considered to define a first utensil or "wash zone" 50.

In addition to one or more of the conventional spray arm wash assemblies 22, 23, 24 described above, the present invention further comprises a second utensil or "wash zone", or more particularly, an intensified wash zone 28. While in the exemplary embodiment, the second wash zone 28 is located adjacent the lower dish rack 27 toward the rear of the tub 12, it could be located at virtually any location within the interior tub 12. The second wash zone 28 has been designed to allow heavily soiled dishes such as casserole dishes to receive the traditional spray arm wash, as well as, an additional concentrated wash action. Thus, a dishwasher having such a zone may not only provide better washing performance for heavily soiled dishware, but may provide overall improved wash performance.

Figure 3:
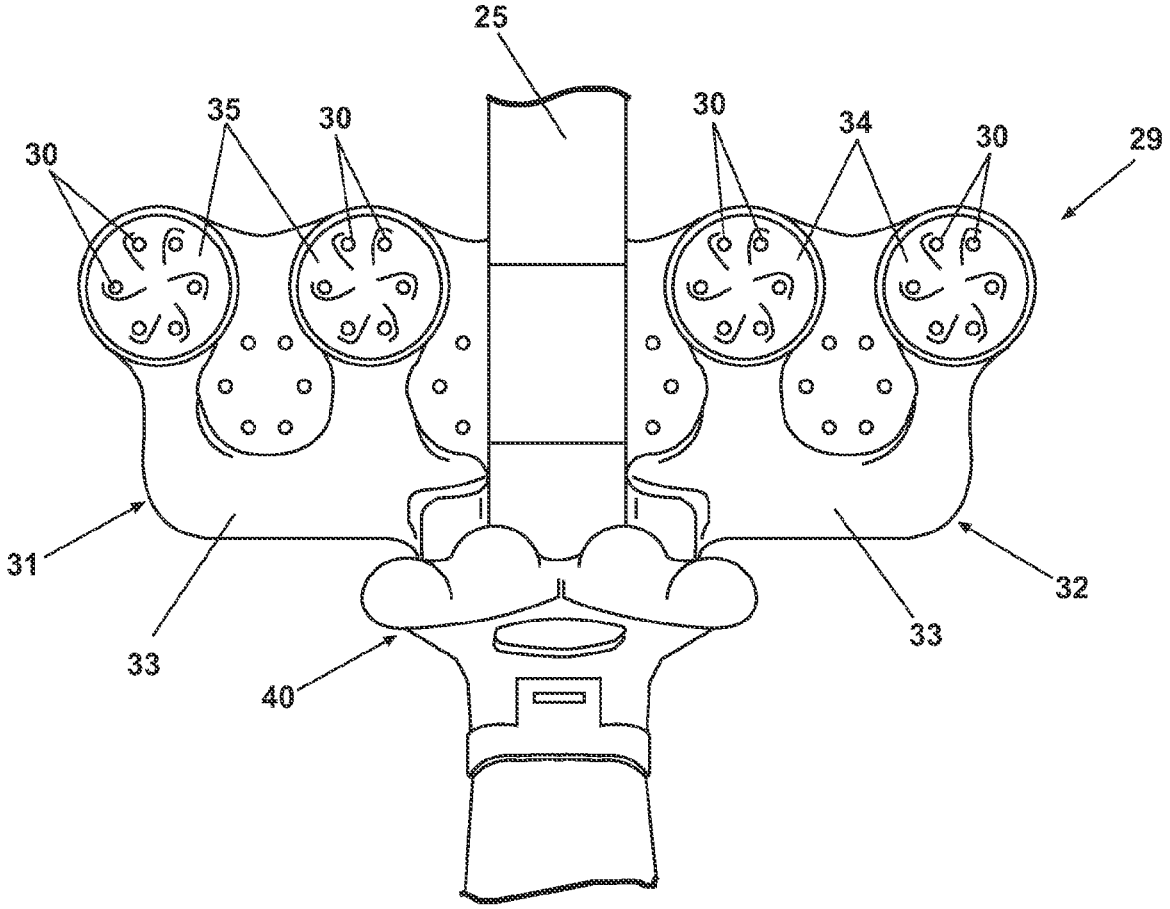
FIG. 3 is a front elevational view of a spray manifold in accordance with the first embodiment of the present invention.

As illustrated in FIG. 3, the second wash zone 28 is achieved by selectively diverting wash liquid from the mid-level and upper spray arm assemblies 23, 24 to a vertically oriented spray manifold 29 positioned on the rear wall 18 of the interior tub 12 adjacent the lower dish rack 26. In this way, a flow of wash liquid is directed toward the lower dish rack 26 from the manifold 29 thereby providing the second wash zone 28. As one of skill in the art should recognize, the spray manifold 29 is not limited to this position, rather, the spray manifold 29 could be located in virtually any part of the interior tub 12. For example, the manifold 29 could be moved up vertically along any portion of the wash liquid supply tube 25 such as to a position adjacent the upper dish rack 27. Alternatively, the manifold 29 could be positioned underneath the lower dish rack 26 adjacent or beneath the lower spray arm assembly 22. The current positioning of the spray manifold 29 was chosen to allow for casserole dishes to be loaded in an upright position, which helps maximize or optimize the amount of dishware that can be loaded in any given cycle.

In the exemplary embodiment, the spray manifold 29 is in fluid communication with the wash liquid supply tube 25 such that wash liquid may be selectively provided to the manifold 29. The manifold 29 is configured to have two symmetrically opposing halves 31, 32 positioned on opposite sides of the supply tube 25 with each half being configured to selectively receive wash liquid being pumped through the supply tube 25. Each half 31, 32 of the manifold 29 comprises a plurality of apertures 30 configured to spray wash liquid into the wash zone 28. Additionally, each half of the manifold is configured with one or more passageways 33 to deliver wash liquid from the supply tube 25 to the apertures 30. As one of skill in the art will appreciate, the wash liquid being pumped through the supply tube 25 will be under pressure as it passes through passageway 33 and out apertures 30, thereby creating an intensified wash zone 28.

As illustrated in FIG. 3, it is contemplated that each half 31, 32 of the spray manifold may comprise two substantially circular nozzles 34, 35 having a plurality of apertures 30 arranged in a substantially circular pattern. Each aperture 30 may be a substantially oval shape and may be provided at any angle with respect to the nozzle or with respect to the spray manifold 29. While the exemplary embodiment of the invention is illustrated in FIG. 3, the present invention is not meant to be limited by this illustration. For example, the spray manifold 29 may extend across virtually any width of the interior wash tub, or may be limited to extending to only one side of the supply tube 25. Moreover, the number of nozzles 34, 35 may vary, as well as the height and positioning of each nozzle. Additionally, the shape, size, angle, arrangement and number of apertures 30 in the manifold 29 may vary as alternative arrangements may provide a more concentrated wash zone. For example, not only can the manifold be configured to provide water flow to a particular area, but the water flow from the manifold may also be configured to have more speed or more volume per area.

Figure 4A:
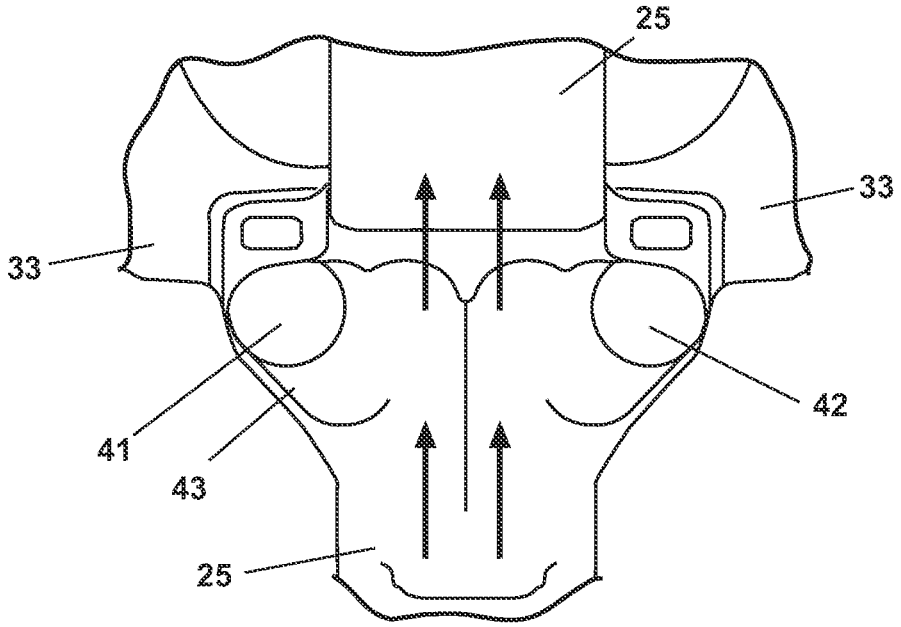
FIG. 4A is a schematic view of a first position of a valve for selectively diverting wash liquid to a supply tube in accordance with the first embodiment of the present invention.
Figure 4B:
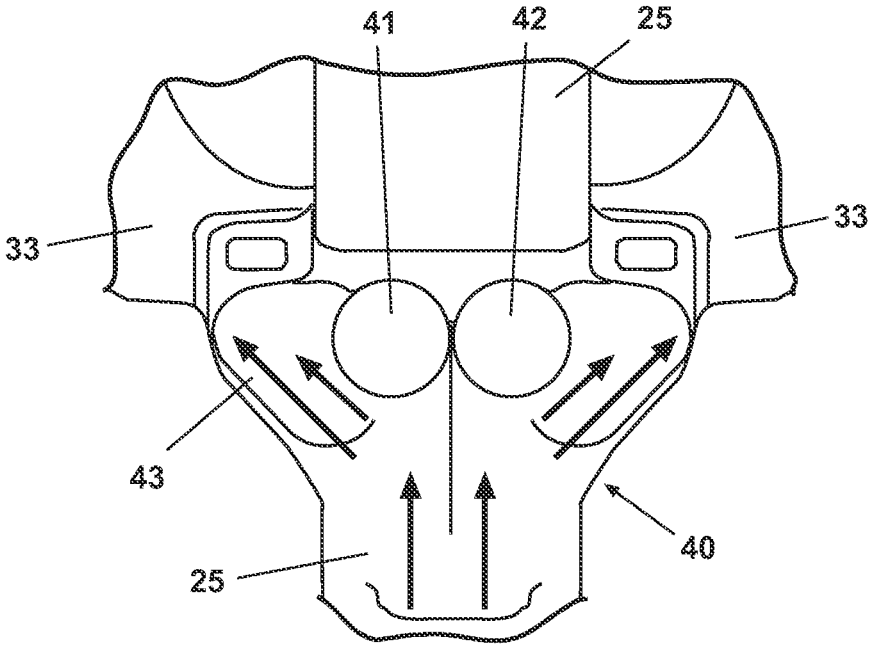
FIG. 4B is a schematic view of a second position of a valve for selectively diverting wash liquid to a spray manifold in accordance with the first embodiment of the present invention.

As shown generally in FIG. 3 and more specifically in FIGS. 4A and 4B, a valve 40 may be provided to selectively divert wash liquid from the mid-level and upper spray arm assemblies 23, 24 to the spray manifold 29. In the exemplary embodiment, the valve 40 is a magnetically actuatable diverter valve positioned in the supply tube 25 and is configured to direct the flow of wash liquid either through the supply tube 25 so it can reach the mid-level and upper spray arm assemblies 23, 24 or through the spray manifold 29 so it can reach the intensified wash zone 28. As one of skill in the art should appreciate, the valve 40 could also be designed to selectively divert water from the lower spray arm 22.

In the exemplary embodiment, the valve 40 comprises a housing 43 and two diverter objects such as magnetic balls 41, 42 preferably having a ferrite core positioned within the housing and configured to be magnetically moved between a first position shown in FIG. 4A and a second position shown in FIG. 4B. In the first position, the diverter objects 41, 42 are magnetically positioned to substantially block passageway 33 associated with both halves 31, 32 of the spray manifold 29. In this way, wash liquid is prevented from entering the manifold 29 and is pushed through the supply tube 25 toward the mid-level and upper spray arm assemblies 23, 24. In the second position, the diverter objects 41, 42 are magnetically positioned to substantially block the supply tube 25, thereby allowing the wash liquid to enter both halves 31, 32 of the manifold 29 through passageway 33. While the exemplary embodiment contemplates that the diverter valve 40 may use a plurality of magnetic objects such as magnetic balls to divert wash liquid between the mid-level and upper spray arm assemblies 23, 24 and the manifold 29, one of skill in the art will recognize that an arrangement of flapper valves, wedges, or other known water diverter mechanisms could be also be used.

Figure 5:
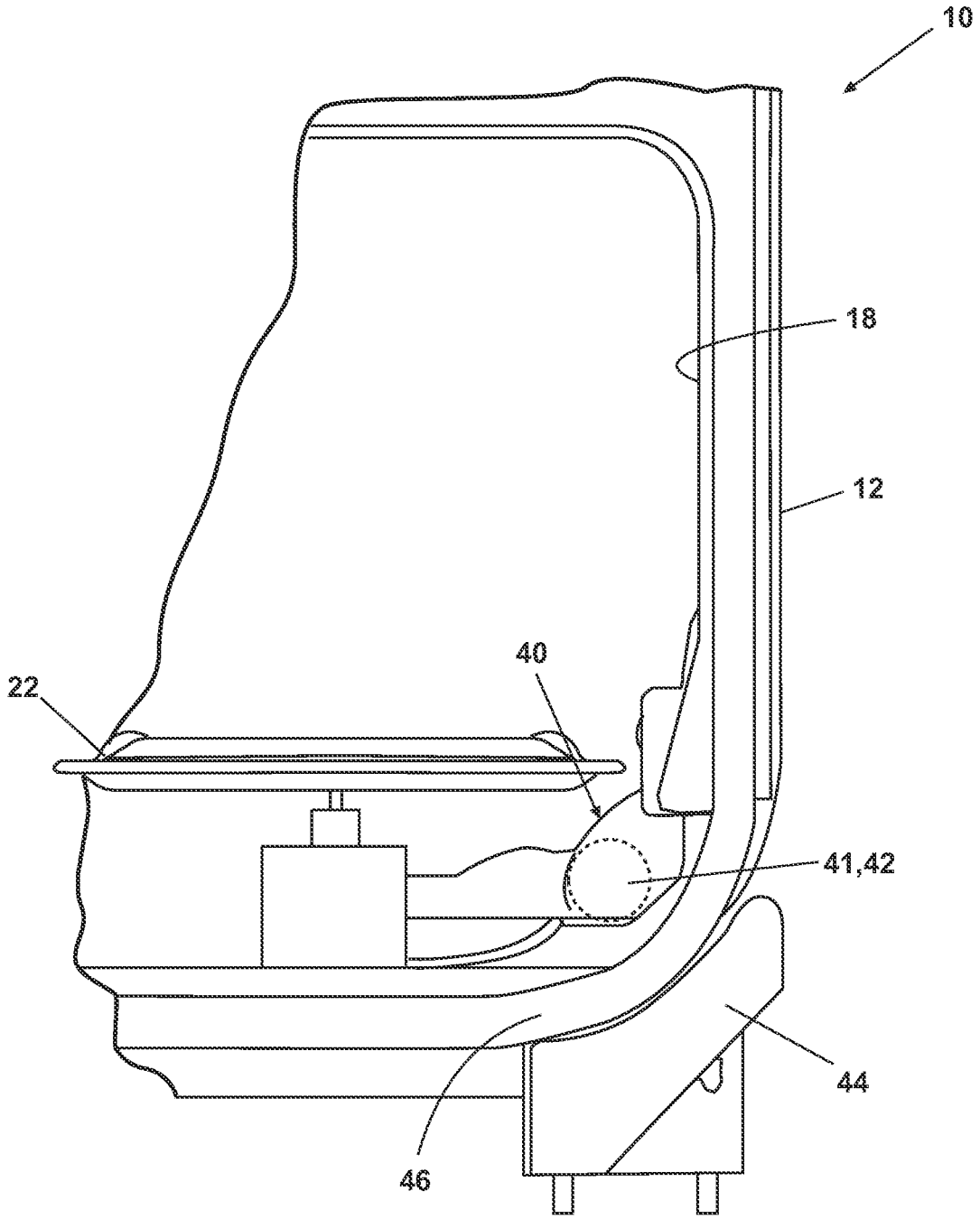
FIG. 5 is a schematic view of the valve and actuator in accordance with the first embodiment of the present invention.

As shown in FIG. 5, an actuator 44 is positioned outside of the housing 43 and behind the tub 12 for magnetically moving the objects 41, 42 from the first position to the second position and vice versa. In the exemplary embodiment, the actuator 44 comprises a magnet with sufficient strength to magnetically manipulate the diverter objects 41, 42. It should be recognized that the magnet could be a permanent magnet, electromagnet or any other type magnet configured to move the diverter objects 41, 42. The actuator 44 can be configured to be mounted to the outside 46 of the tub 12 in any variety of ways and can be configured to be in communication with and controlled by the dishwasher's control panel (not shown) or the wash programs associated with the dishwasher 10. It should be recognized that to take advantage of the second wash zone 28, the dishwasher 10 might be configured with customized wash cycle options that provide for zone actuation at optimal cycle intervals.

Figure 6:
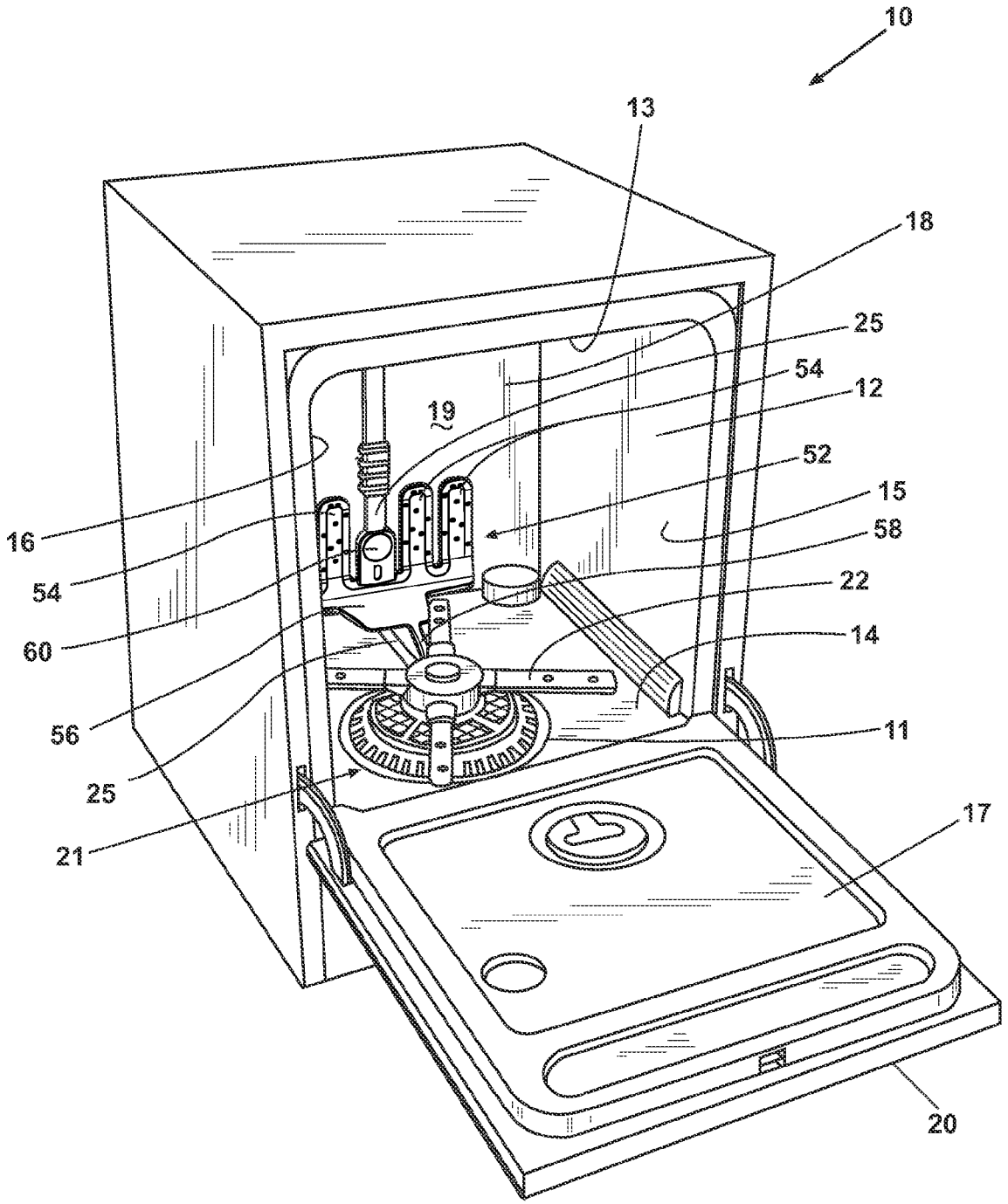
FIG. 6 is a perspective view of a dishwasher having a spray manifold in accordance with a second embodiment of the present invention.

FIG. 6 is a perspective view of a dishwasher 10 having a spray manifold 52 in accordance with a second embodiment of the present invention. The dishwasher 10 can be substantially similar to the dishwasher 10 shown in FIG. 1, with the exception that the spray manifold 52 is employed in place of the spray manifold 29.

The spray manifold 52 comprises multiple sprayers 54 through which liquid is sprayed into the wash chamber 19. The sprayers 54 are fluidly coupled to a common liquid distribution header 56. A supply conduit 58 supplies liquid to the spray manifold 52 from a liquid source and is fluidly coupled to the liquid distribution header 56. A bracket 60 positioned between the sprayers 54 is used to couple the spray manifold 52 to the tub 12, and can extend around the supply tube 25 to secure the spray manifold 52 to the rear wall 18 of the tub 12. The sprayers 54, liquid distribution header 56, supply conduit 58, and bracket 60 can be integrally formed together as a single molded piece. Alternatively, one or more of the components of the spray manifold 52 can be formed separately and physically coupled together, using suitable sealing means as needed to create a fluid-tight spray manifold 52.

Figure 7:
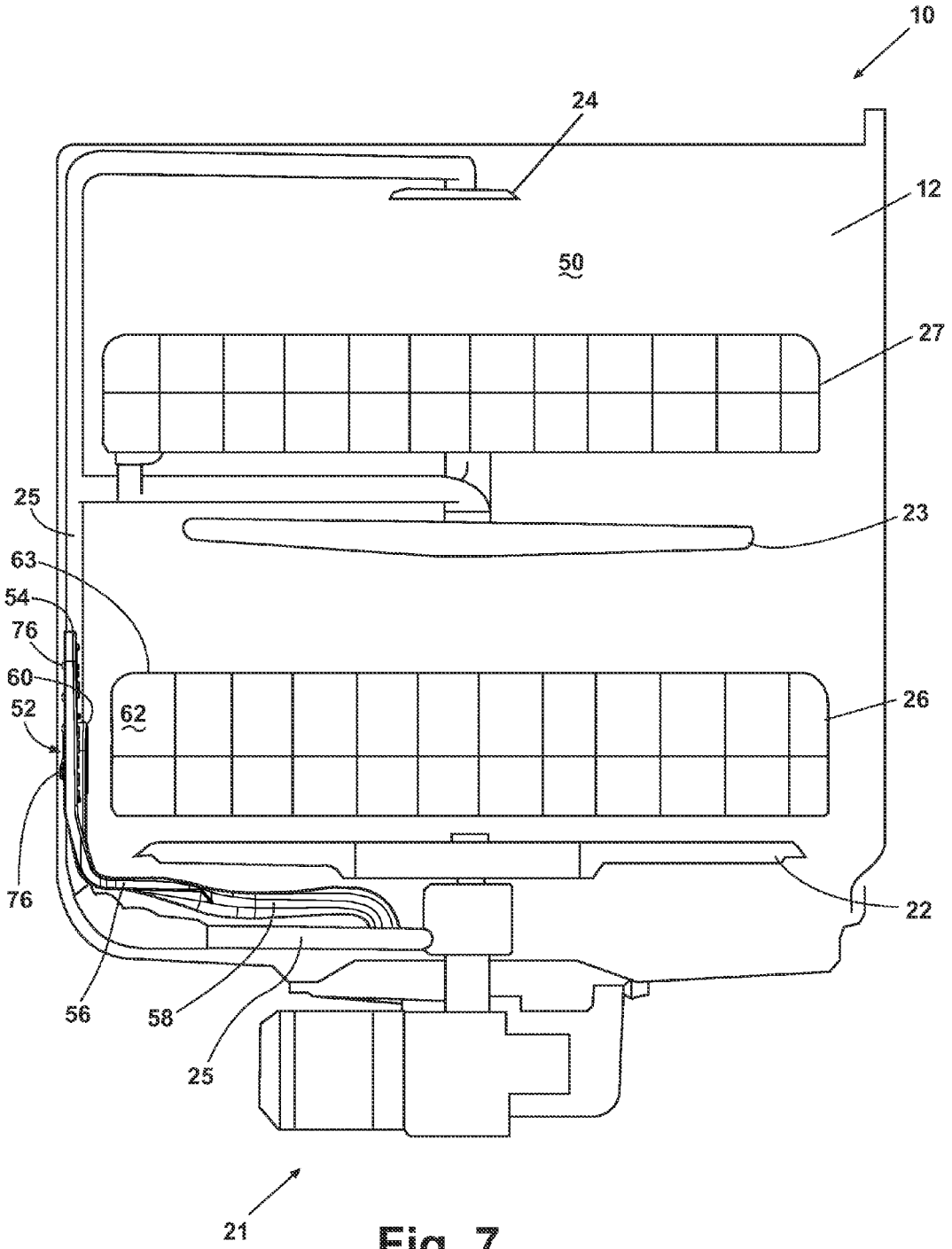
FIG. 7 is a schematic, cross-sectional view of the dishwasher shown in FIG. 6.

FIG. 7 is a schematic, cross-sectional view of the dishwasher 10 shown in FIG. 6. The spray manifold 52 can be positioned adjacent the rear wall 18 of the interior tub 12 adjacent the lower dish rack 26. In this way, a flow of wash liquid is directed toward the lower dish rack 26 from the manifold thereby providing a second utensil or wash zone 62. Like the first embodiment, the first wash zone 50 is provided by the spray of wash liquid from any one or combination of the spray arm assemblies 22, 23, 24. The spray manifold 52 can extend in a generally horizontal manner across a partial width of the lower dish rack 26. However, the spray manifold 52 may extend across virtually any width of the rack 26 or tub 12. Furthermore, one or more of the multiple sprayers 54 can extend above an upper edge 63 of the lower dish rack 26 such that the sprayers 54 not only spray through the side of the lower dish rack 26, but also across the top of the lower dish rack 26. The position of the spray manifold 52 shown, particularly the sprayers 54 extending both below and above the upper edge 63 of the lower dish rack 26, allows for casserole dishes or 9"×13" pans to be loaded into the lower dish rack 26 in an upright position, which helps maximize or optimize amount of dishware that can be loaded in any given cycle while still effectively cleaning the casserole dish or 9"×13" pan.

The spray manifold 52 can include at least one spacer 76 that provides a gap between the rear side of the spray manifold 52 and the rear wall 18 of the tub 12. As shown, multiple spacers 76 are provided on the spray manifold 52.

The gap created by the spacers 76 permits some wash liquid to flow between the spray manifold 52 and the tub 12, which rinses soil out of the gap and prevents the accumulation of soil behind the spray manifold 52.

Figure 7A:
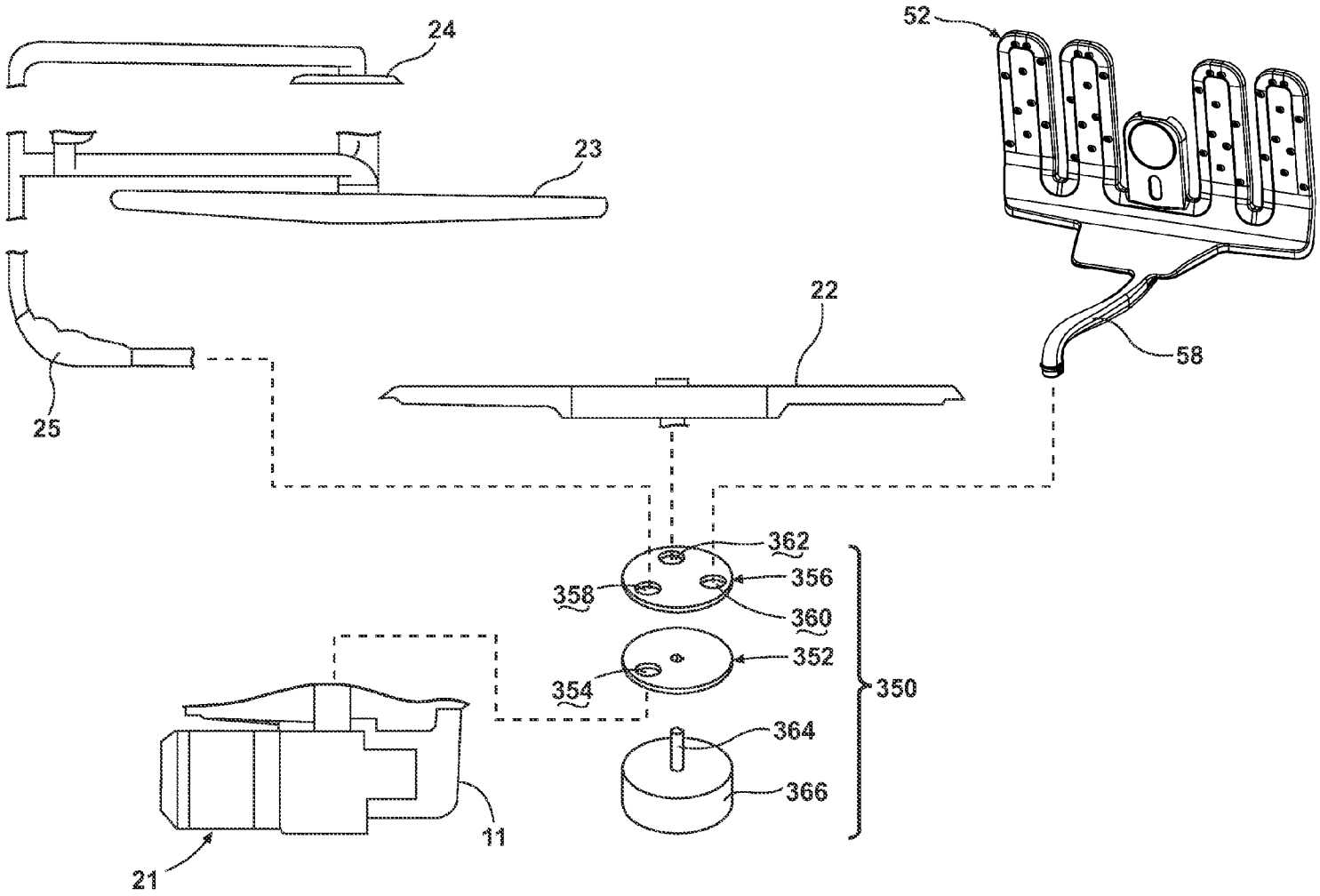
FIG. 7A is a schematic illustration of a liquid supply system of the dishwasher 10.

FIG. 7A is a schematic illustration of a liquid supply system of the dishwasher 10. In the second embodiment, the spray manifold 52 is configured to receive liquid from the supply conduit 58. Therefore, rather than being in fluid communication with the supply tube 25 that provides liquid to either or both of the mid-level and upper spray arm assemblies 23, 24, as in the first embodiment, the spray manifold 52 receives liquid via the separate and dedicated supply conduit 58 that extends along the bottom wall of the tub 12 to the liquid distribution header 56.

A suitable valve mechanism 350 can be provided such that only one of the supply tube 25 and supply conduit 58 can receive liquid at one time. Such a valve mechanism 350 is set forth in detail in U.S. patent application Ser. No. 12/908,915, filed Oct. 21, 2010, now U.S. Pat. No. 8,834,648, issued Sep. 16, 2014, and titled "Dishwasher with Controlled Rotation of Lower Spray Arm," which is incorporated herein by reference in its entirety. The valve mechanism 350 can comprise a diverter valve that includes a diverter disk 352 having at least one port 354 for selectively liquid to the supply tube 25 or the supply conduit 58 and that rotates relative to a diverter base 356 having at least two fluid passages. As shown herein, the diverter base 356 includes a first passage 358 in fluid communication with the supply tube 25, a second passage 360 in fluid communication with the supply conduit 58, and a third passage 362 in fluid communication with the lower spray arm assembly 22. The diverter disk 352 can be operably coupled with a drive shaft 364 of a motor 366 and is rotated as the motor 366 drives the drive shaft 364.

The valve mechanism 350 can be supplied with liquid from the sump 11 by operating the pump assembly 21, which will draw wash liquid from the sump 11 and to pump the liquid to the port. Alignment of the port 354 in the diverter disk 352 with one of the passages permits the flow of liquid to the spray element associated with that passage. For example, when the port 354 is aligned with the first passage 358, liquid is emitted from the mid-level and upper spray arm assemblies 23, 24 via the supply tube 25. When the port 354 is aligned with the second passage 360, liquid is emitted from the spray manifold 52 via the supply conduit 58. When the port 354 is aligned with the third passage 362, liquid is emitted from the lower spray arm assembly 22. While not illustrated herein, more than one port 354 can be provided in the diverter disk 352, such that more than one passage 358, 360, 362 can be supplied with liquid at a time.

In an alternate configuration of the liquid supply system of the dishwasher 10, liquid can be provided to the spray manifold 52 at the same time that liquid is provided to the mid-level and upper spray arm assemblies 23, 24. In another configuration, the valve 40 disclosed above for the first embodiment can be used to divert liquid between the supply tube 25 and the supply conduit 58.

Figure 8:
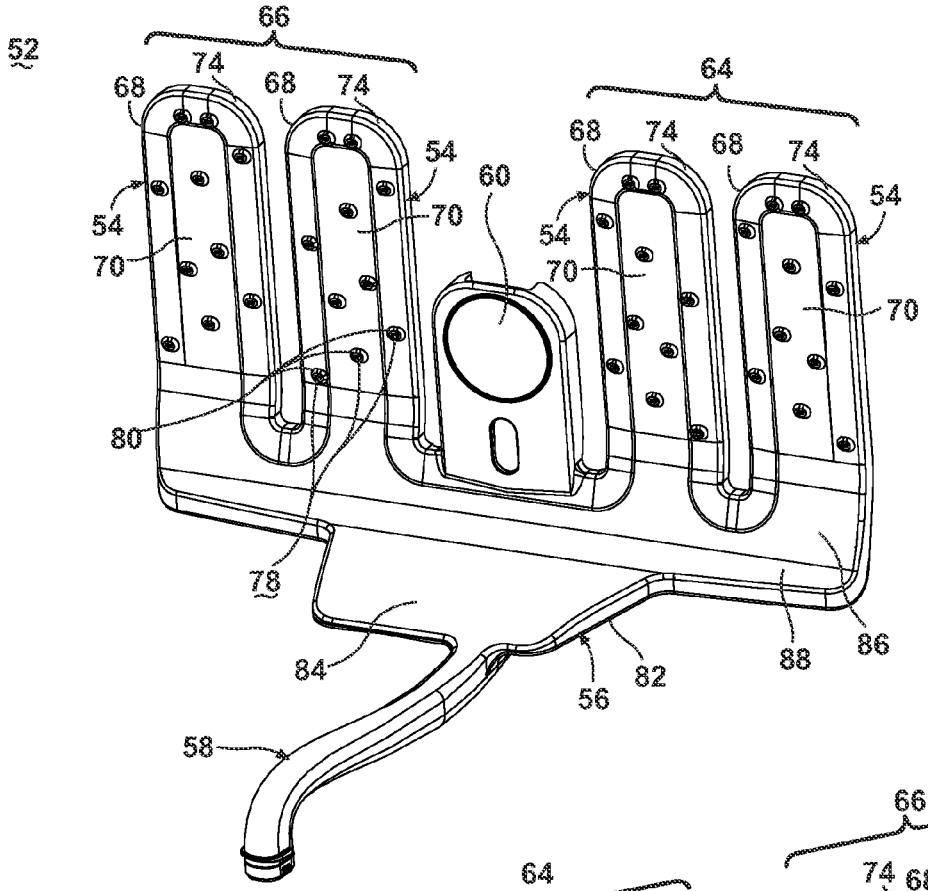
FIG. 8 is a front perspective view of the spray manifold from FIG. 6.
Figure 9:
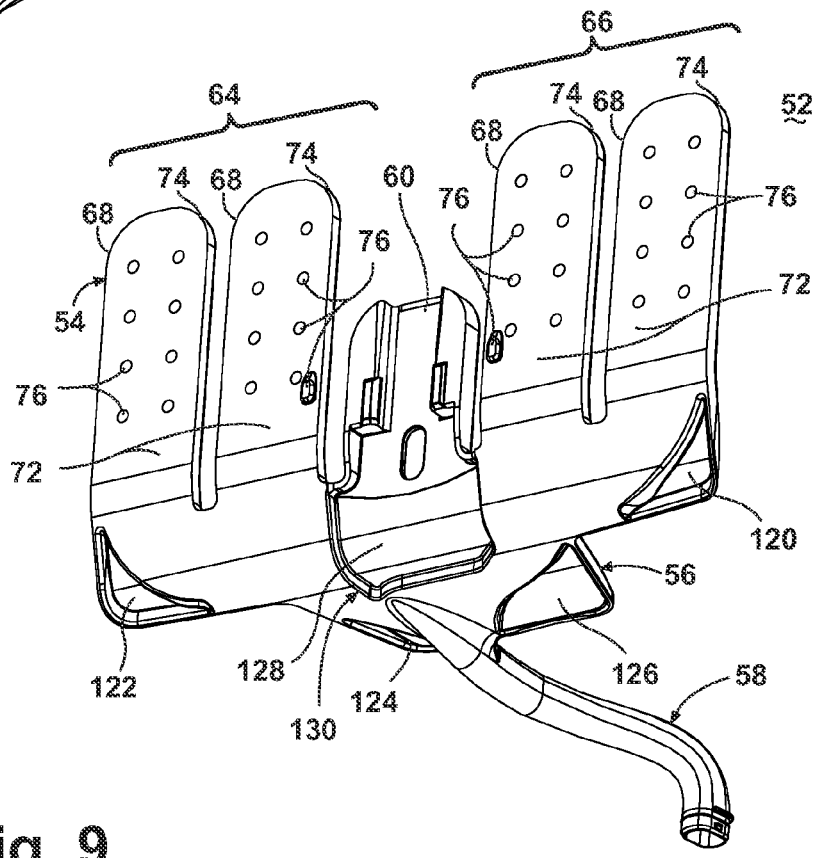
FIG. 9 is a rear perspective view of the spray manifold from FIG. 6.

FIGS. 8 and 9 are front and rear perspective views of the spray manifold 52 from FIG. 6. As shown, the spray manifold 52 is configured to have two branches, a right branch 64 and a left branch 66, as viewed from the perspective of a user standing in front of and facing the open dishwasher 10 of FIG. 6, which selectively receive wash liquid being pumped through the supply conduit 58. As shown, the two branches 64, 66 may be symmetrically opposing and may be positioned opposite sides of the bracket 60. The branches 64, 66 are further positioned on opposite sides of the supply conduit 58, but unlike the position of the branches 64, 66 with respect to the bracket 60, are not symmetrically positioned with respect to the supply conduit 58. In the illustrated configuration, the right branch 64 is closer to the supply conduit 58 than the left branch 66. Alternatively, the branches 64, 66 may be non-symmetrical and/or may be provided on the same side of the bracket 60 and/or supply conduit 58.

Each branch 64, 66 is in fluid communication with the liquid distribution header 56 and is provided with one or more of the multiple sprayers 54 of the spray manifold 52. As shown herein, each branch 64, 66 is provided with two sprayers 54. It is also within the scope of the invention for each branch 64, 66 to be provided with a different or non-equal number of sprayers 54.

As illustrated, each sprayer 54 has a generally flat finger-like body 68 that extends upwardly from the liquid distribution header 56 to a free upper end. Each body 68 has an inner surface 70 that faces the wash chamber 19 and an outer surface 72 that faces the rear wall 18 of the tub 12 and which is joined to the inner surface 70 by a narrow peripheral side surface 74 that extends around three sides of the body 68. The outer surface 72 of one or more of the bodies 68 can include at least one of the spacers 76; as shown, multiple spacers are provided on the outer surface 72 of each body 68, and can be arranged as an array of raised protrusions on the outer surface 72.

Each body 68 has a plurality of apertures 78 configured to spray wash liquid outwardly. The inner surface 70 of the body 68 includes raised protrusions 80 in which the apertures 78 are formed. Each aperture 78 may be substantially oval in shape, although other shapes, such as circular, are possible. As one of skill in the art will appreciate, the wash liquid being pumped through the supply conduit 58 can be under pressure as it passes through the apertures 78, thereby creating an intensified wash zone. The spray from the apertures 78 collectively define the spray zone 62 directed toward the lower dish rack 26 shown in FIG. 7.

The liquid distribution header 56 has a generally L-shaped body 82 having a lower portion 84 that extends outwardly from the supply conduit 58 and an upper portion 86 which extends to the sprayers 54. The lower portion 84 extends generally horizontally and is configured to extend along the bottom wall 14 of the tub 12 (FIG. 6). The upper portion 86 extends generally vertically and is configured to extend along the rear wall 18 of the tub 12 (FIG. 6). The lower and upper portions 84, 86 are joined together by a curved portion 88 which extends over the corner between the bottom and rear walls 14, 18 (FIG. 6). As shown in FIG. 8, the upper surface of the header body 82 can be relatively smooth and without surface features while as shown in FIG. 9, the lower surface of the header body 82 can have surface features which designate the flow paths of liquid through the liquid distribution header 56.

Figure 10:
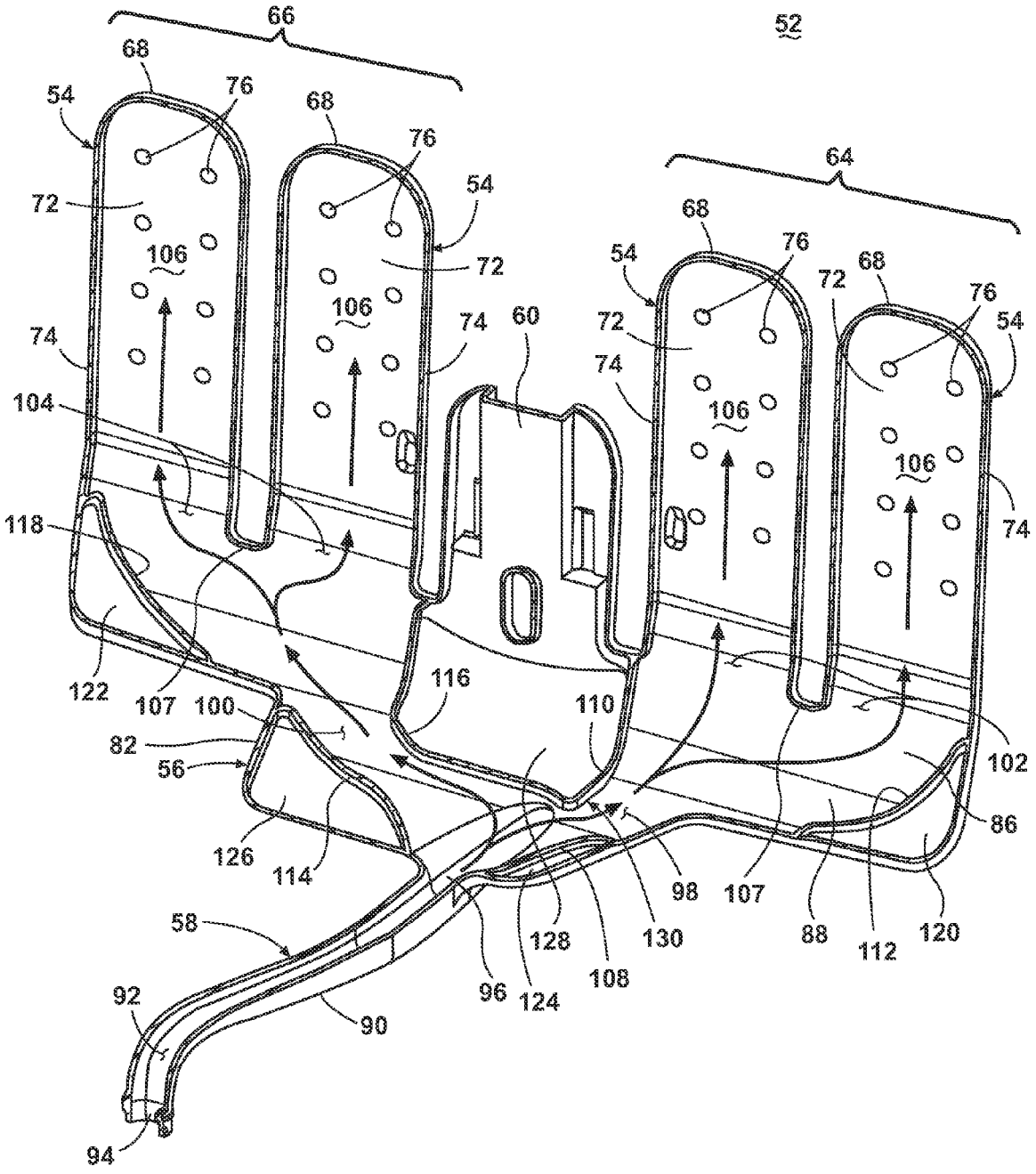
FIG. 10 is a front perspective view of the spray manifold from FIG. 6, with a portion of the spray manifold cut away to illustrate the liquid flow paths through the spray manifold.

FIG. 10 is a front perspective view of the spray manifold 52, with a portion of the spray manifold 52 cut away to illustrate the liquid flow paths through the spray manifold 52. Specifically, many of the upper and inner surfaces of the spray manifold 52 are removed for clarity.

The supply conduit 58 comprises an elongated tube 90 defining an interior supply flow path 92 having a first end defining an inlet 94 of the interior supply flow path 92 in fluid communication with a liquid source, such as the sump 11, and a second end which joins the liquid distribution header 56 and defines an outlet 96 of the interior supply flow path 92.

The liquid distribution header 56 defines an interior flow path having multiple channels 98, 100 that deliver wash liquid from the supply conduit 58 to the branches 64, 66. The number of channels can correspond to the number of branches, with each of the channels in fluid communication with one corresponding branch. Since the illustrated embodiment has a right and left branch 64, 66, the liquid distribution header 56 has a corresponding right channel 98 and left channel 100. The channels 98, 100 can have a common inlet, namely, the outlet 96 of the supply conduit 58. However, each channel 98, 100 has its own outlet 102, 104, respectively, thereby, fluidly isolating the two branches 64, 66 from each other. The outlet can be formed by multiple separate openings, which can correspond to the number of sprayers 54 for each branch 64, 66. Since the illustrated embodiment has two sprayers 54 per branch 64, 66, the outlet of each channel 98, 100 will have two openings 102, 104. The openings 102, 104 on each branch 64, 66 can be separated from each other by a divider 107 connecting the peripheral side walls of the adjacent sprayers 54.

Likewise, each branch 64, 66 defines an interior flow path having multiple passageways 106 that deliver wash liquid from the liquid distribution header 56 to the apertures 78 of the sprayers 54. The number of passageways 106 can correspond to the number of sprayers 54, with each of the passageways 106 in fluid communication with one corresponding sprayer 54. Since the illustrated embodiment has two sprayers 54 for each branch 64, 66, each branch 64, 66 has two corresponding passageways 106. The passageways 106 can have a common inlet, namely, the outlet openings 102 or 104 of the channels 98, 100. However, each passageway 106 has its own outlet, collectively defined by the apertures 78 of the associated sprayer 54, thereby, fluidly isolating the two sprayers 54 of each branch 64, 66 from each other. In the illustrated embodiment, all of the passageways 106 are similar to each other, and can, therefore, have the same cross-sectional area as each other.

The tube 90, channels 98, 100, and passageways 106 can collectively define multiple liquid flow paths through the spray manifold 52. A liquid flow path through the spray manifold 52 can be thought of as the flow path of liquid traveling from the supply conduit 58 to one of the sprayers 54 and through the apertures 78 of that sprayer 54. Thus, the spray manifold 52 shown herein comprises four distinct liquid flow paths. Under a narrower classification, a liquid flow path through the spray manifold 52 can be thought of as the flow path of liquid traveling from the supply conduit 58 to one of the apertures 78 of the sprayer manifold 52. Using this classification, the spray manifold 52 shown herein comprises forty distinct liquid flow paths since forty apertures 78 are provided on the spray manifold 52.

The interior flow path of the liquid distribution header 56 can be configured to minimize pressure loss from the inlet to the channels 98, 100, to the branches 66, 64. The embodiment of the invention shown herein employs multiple techniques for minimizing pressure loss. First, the interior flow path of the liquid distribution header 56 can be configured to lack any sharp transitions between the channel 98, 100 and its associated branch 64, 66 to reduce or eliminate any areas of turbulent flow in the interior flow path. The reduction or elimination of turbulent flow within the spray manifold 52 can help minimize pressure loss.

As shown in FIG. 10, the channels 98, 100 are formed by a combination of straight, curved and angled walls which guide the flow of liquid through the channel 98, 100 to the associated branch 64, 66. Specifically, the right channel 98 includes an outer wall 108 and an inner wall 110, both of which can include smooth transitions along their respective lengths. The outer wall 108 can eventually merge with the peripheral side surface 74 of the outermost sprayer 54 on the right branch 64, while the inner wall 110 can likewise eventually merge with the peripheral side surface 74 of the innermost sprayer 54 on the right branch 64. The outer wall 108 can include a rounded corner 112 that directs liquid toward the outermost sprayer 54. Furthermore, the divider 107 that separates the outlet openings 102 of the right channel 98 can be rounded as well.

The left channel 100 includes an outer wall 114 and an inner wall 116, both of which can include smooth transitions along their respective lengths. The outer wall 114 can eventually merge with the peripheral side surface 74 of the outermost sprayer 54 on the left branch 66, while the inner wall 116 can likewise eventually merge with the peripheral side surface 74 of the innermost sprayer 54 on the left branch 66. The outer wall 114 can also include a rounded corner 118 that directs liquid toward the outermost sprayer 54. Furthermore, the divider 107 that separates the outlet openings 104 of the left channel 100 can be rounded as well.

The rounded corners 112, 118 of each channel 98, 100 can be formed by depressing sections of the curved portion 88 of the liquid distribution header 56, which eliminates the otherwise sharp transitions created by the outer corners of the liquid distribution header 56. As shown, both corners of the curved portion 88 are depressed to seal them against liquid flow, thereby, forming a right upper sealed corner 120 adjacent the right channel 98 and a left upper sealed corner 122 adjacent the left channel 100. Thus, while the outer profile of the spray manifold 52 may include sharp transitions and corners, the interior flow path through the spray manifold 52 can be configured to eliminate these sharp transitions and corners.

The liquid distribution header 56 can include additional depressed sections which define the shape of the channels 98, 100. As shown in FIG. 10, the corners of the lower portion 84 of the liquid distribution header 56 are depressed to seal them against liquid flow, thereby, forming a right lower sealed corner 124 which defines a portion of the outer wall 108 of the right channel 98 and a left lower sealed corner 126 which defines a portion of the outer wall 114 of the left channel 100. At least a portion of the inner walls 110, 116 of the channels 98, 100 can be defined by depressing a central portion of the header body 82 to seal this area against liquid flow, thereby, forming a central sealed area 128 in the liquid distribution header 56.

A second technique employed by the embodiment of the spray manifold 52 shown in the figures for minimizing pressure loss is to configure the interior flow path of the liquid distribution header 56 such that the volumetric flow rate requirement of each channel 98, 100 corresponds to or matches that of its associated sprayers 54. Each sprayer 54 has a predetermined minimum volumetric flow rate requirement for producing an effective spray action from the spray manifold 52. Liquid supplied to any of the sprayers 54 through channel 98 or 100 at the minimum or higher volumetric flow rate required for the sprayer 54 can produce an effective spray action. Effective spray action is essentially a continuous or near-continuous spray of liquid from the sprayer 54 that, at a minimum, reaches utensil items within the spray zone 62, but, at its maximum, will not move the utensil items. The liquid pressure at the sprayer 54 can also be sufficient to reach the tallest utensil item that will fit in the spray zone 62 of the lower dish rack 26.

In embodiments where the sprayers 54 are organized on different branches, such as in the illustrated embodiment where two sprayers 54 are provided per branch 64, 66, the volumetric flow rate requirement of each branch 64, 66 can correspond directly to the volumetric flow rate requirements of the sprayers 54 provided on each branch 64, 66; more specifically, the volumetric flow rate requirement of each branch 64, 66 will be approximately the sum of the volumetric flow rate requirements of the sprayers 54 provided thereon. In this case, the interior flow path of the liquid distribution header 56 can be configured such that the volumetric flow rate requirement of each channel 98, 100 corresponds to or matches that of its associated branch 64, 66.

The volumetric flow rate through each portion of the spray manifold 52, whether it is one of the sprayers 54, one of the branches 64, 66, or one of the channels 98, 100, may be quantified as a function of the volume of liquid which passes through a given cross-sectional area of the portion and the velocity of the liquid flowing through the portion. In this case, since liquid is supplied to the spray manifold 52 from a common source, i.e. from the supply conduit 58, the velocity of the liquid flowing through each portion of the spray manifold 52 will be about equal. Furthermore, in this case, the individual sprayers 54 are identical to each other, and, therefore, have the same cross-sectional area at given planes through the sprayers 54 and may accommodate the same volume of liquid. The channels 98, 100 may also have the same cross-sectional area since each feeds an equal number of identical sprayers 54. However, the cross-sectional area of the liquid flow paths through the channels 98, 100 in the location of the liquid distribution header 56 may be different for each channels 98, 100. The cross-sectional area of the liquid flow paths through the channels 98, 100 may be proportional to the total requirement on each branch 64, 66. For example, if the right branch 64 were instead provided with three sprayers 54 while the left branch 66 were provided with one sprayer 54, then the cross-sectional area of the right channel 98 would be three times greater than that of the left channel 100. Furthermore, the inlet and outlet of the interior flow path of the liquid distribution header 56 can have equal cross-sectional areas.

Due to the off-center placement of the supply conduit 58 with respect to the liquid distribution header 56, proper distribution of liquid to the sprayers 54 in order to meet their respective volumetric flow rate requirements can be problematic. The liquid distribution header 56 can comprise a flow diverter 130 for proportionally dividing the liquid supplied from the supply conduit 58 to the multiple sprayers 54 in proportion to the volumetric flow rate requirement of each sprayer. The flow diverter 130 can be a stationary formation in the liquid distribution header 56 that is positioned in opposing relationship to the outlet opening 96 of the supply conduit 58. The flow diverter 130 can be located to proportionally divide the cross-sectional area of the outlet opening 96 in correspondence with the volumetric flow rate requirement of the sprayers 54. In the illustrated embodiment, since the outlet opening 96 is positioned closer to the right branch 64 than the left branch 66, a greater amount of incoming liquid tends to flow toward the right branch 64. However, the flow diverter 130 directs a portion of that liquid back toward the left branch 66 such that the volumetric flow requirements of each branch 64, 66, and thus each sprayer 54, are met.

In embodiments where the sprayers 54 are organized on different branches, such as in the illustrated embodiment where two sprayers are provided per branch 64, 66, the flow diverter 130 can proportionally divide the liquid supplied from the supply conduit 58 in proportion to the volumetric flow rate requirement of each branch 64, 66, which is necessarily dependent on the volumetric flow rate requirement of the sprayers 54 provided on each branch 64, 66. The flow diverter 130 can be located to proportionally divide the cross-sectional area of the outlet opening 96 in correspondence with the volumetric flow rate requirement of the two branches 64, 66, i.e. the sum of the volumetric flow rate requirements of the sprayers 54 provided on each branch 64, 66.

Figure 11:
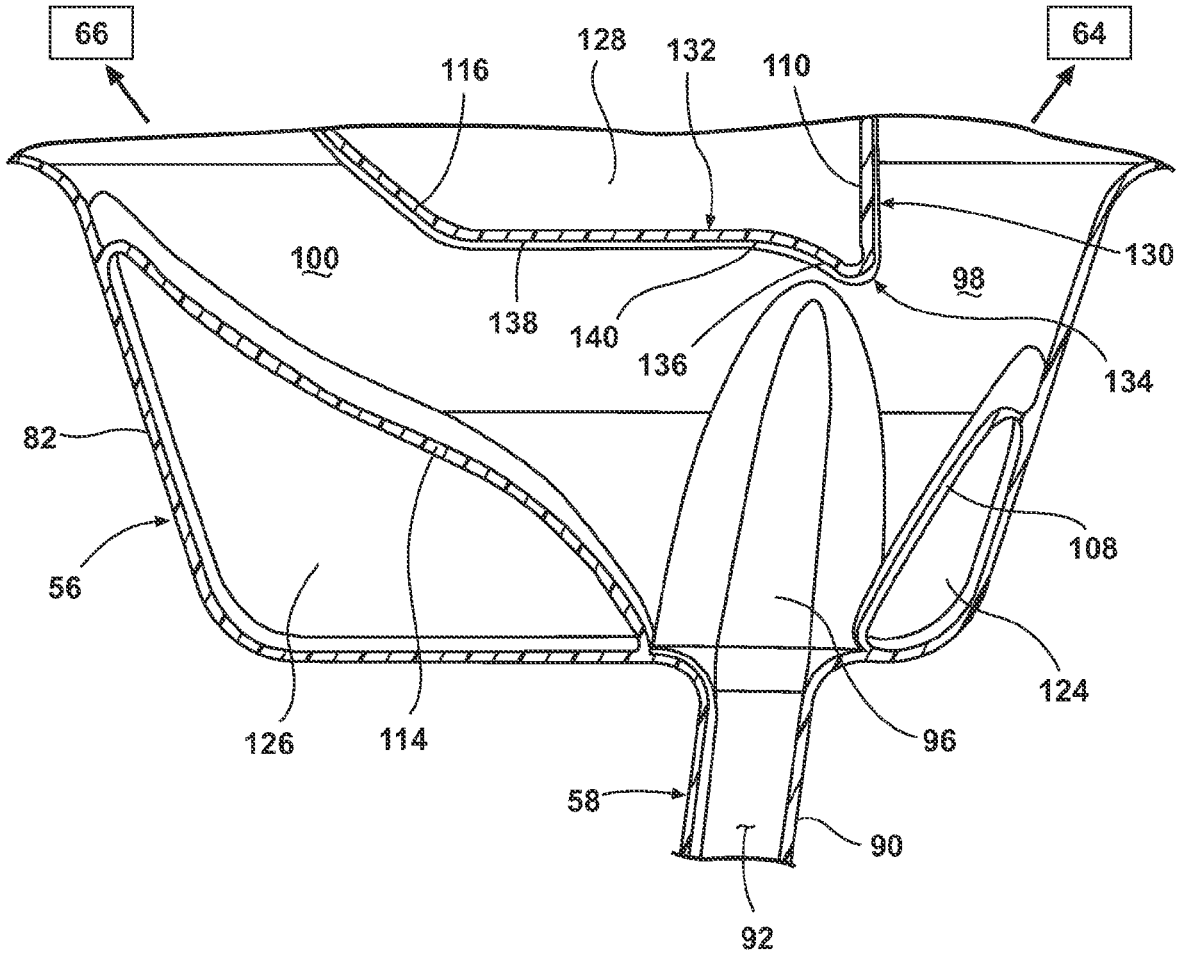
FIG. 11 is a top view of a portion of FIG. 10, illustrating a flow divider provided in the spray manifold.

FIG. 11 is a top view of a portion of FIG. 10, illustrating the flow divider 130. The flow diverter 130 can comprise a deflector wall 132 positioned in opposing relationship to the outlet opening 96 of the supply conduit 58 and a nose 134 from which the deflector wall 132 extends and that is configured to divide the liquid supplied from the supply conduit 58 into two separate flows. As shown herein, the deflector wall 132 is positioned to guide wash liquid to the left branch 66, and can be shaped in accordance with the volumetric needs of the left branch 66. The illustrated deflector wall 132 includes an angled portion 136 extending away from the nose 134 at an incline to the outlet opening 96, a relatively straight portion 138, and a curved transition portion 140 which joins the angled portion 136 with the straight portion 138. The straight portion 138 merges with the inner wall 116 of the left channel 100. The nose 134 merges with the inner wall 110 of the right channel 98.

In operation, as liquid is supplied to the spray manifold 52, due to the off-center placement of the supply conduit 58, a greater amount of incoming liquid tends to flow toward the right branch 64 than the left branch 66. However, the configuration of the liquid distribution header 56 acts to proportionally distribute the liquid to each branch 64, 66 according to the volumetric flow rate requirement of each sprayer 54 on the branch 64, 66. In the illustrated embodiment, the flow diverter 130 directs a portion of the liquid back toward the left branch 66 such that the volumetric flow requirements of each branch 64, 66, and, thus, each sprayers 54, are met. The flow diverter 130 divides the liquid into two flows of liquid, one directed toward the right branch 64 and one directed toward the left branch 66. However, in other embodiments where more than two branches are provided, the liquid distribution header 56 can be configured such that liquid is divided into more than two flows, which may be accomplished, for example, by providing multiple flow diverters 130.

The liquid flow directed toward each branch 64, 66 will be further divided into two flows by the divider 107, each going into a different lateral passageway 106. In each passageway 106, the liquid will be sprayed from the apertures 78 in the sprayer 54.

The passageways 106 are configured to supply liquid to the sprayers 54 at the same volumetric flow rate. In the illustrated embodiment, since each sprayer 54 has the same configuration, liquid will be emitted from each sprayer 54 at the same flow rate, which creates a consistent cleaning effect across the spray zone 62 of the spray manifold 52.

Also during operation, liquid may be sprayed from one or more of the spray arm assemblies 22, 23, 24 provided in the treating chamber 19 of FIG. 7. In this manner, multiple spray zones may be created within the treating chamber 19, each associated with one of the spray arm assemblies 22, 23, 24 or with the spray manifold 52, to provide an enhanced cleaning operation.

Figure 12:
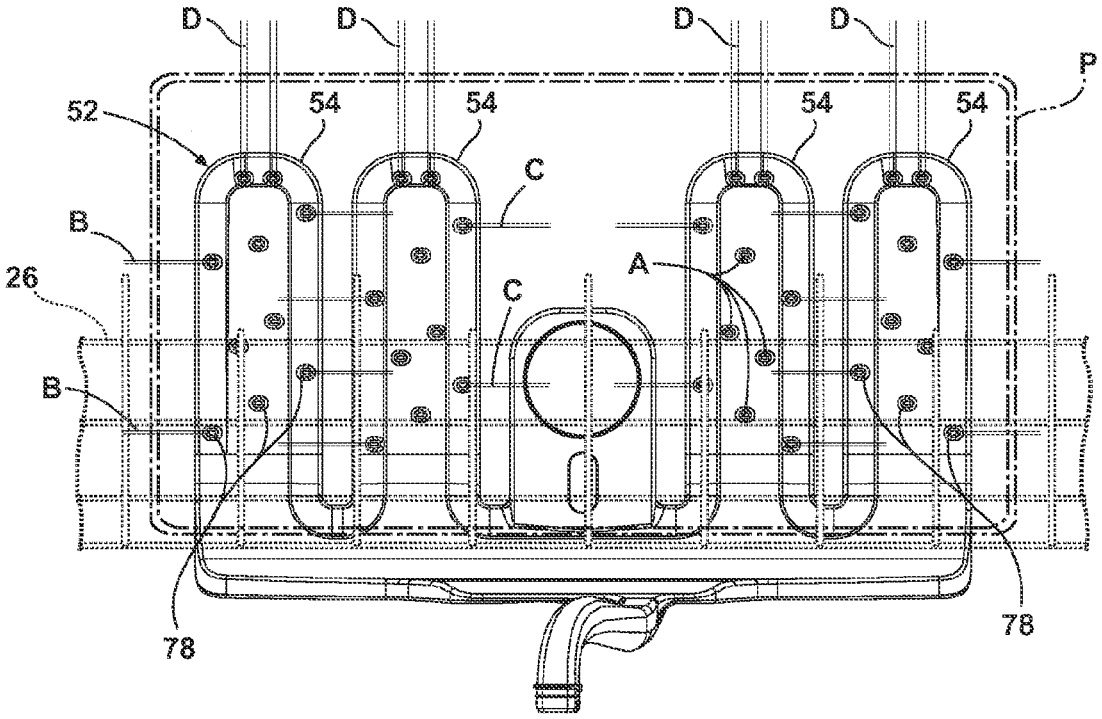
FIGS. 12 and 13 are schematic front and side views of the spray manifold from FIG. 6, illustrating the spray pattern of wash liquid from the spray manifold.
Figure 13:
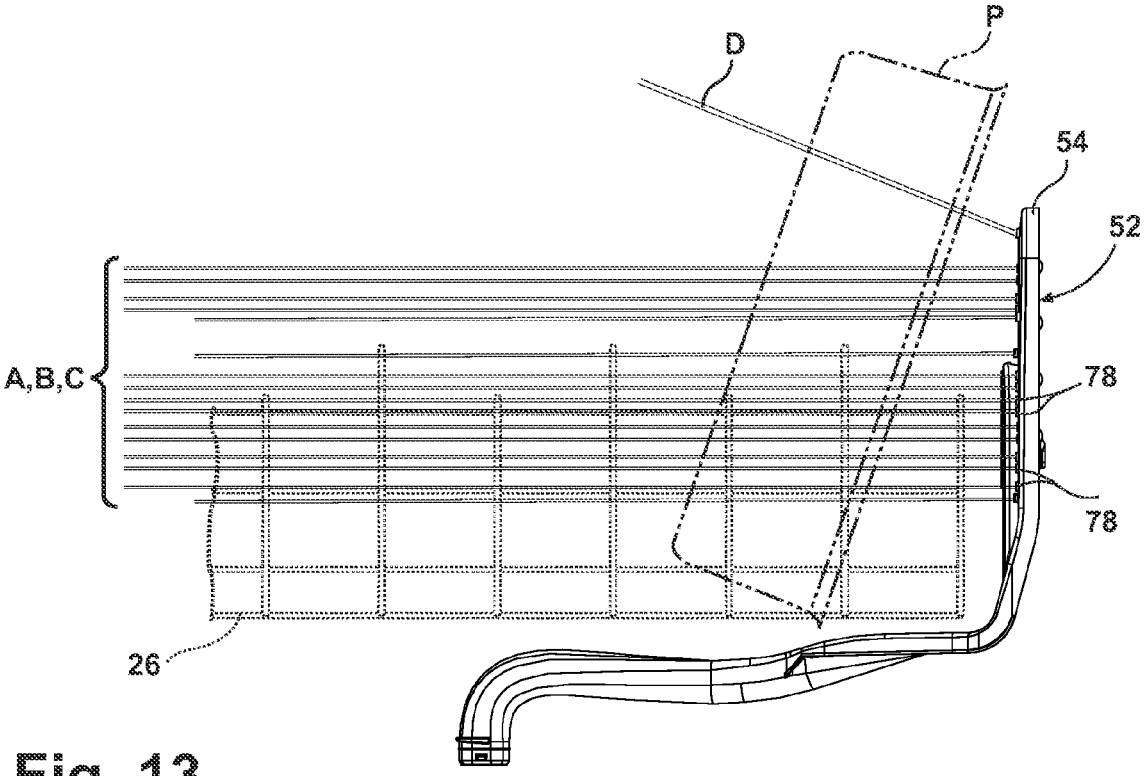

FIGS. 12 and 13 are schematic front and side views of the spray manifold 52, illustrating the spray pattern of wash liquid from the spray manifold 52. The apertures 78 can be configured to optimize the coverage provided by the spray manifold 52. For example, the apertures 78 can be arranged in a pattern that varies the vertical and horizontal location of the apertures 78 on each sprayer 54. The pattern can be asymmetrical with respect to each sprayer 54, or across the spray manifold 52. Furthermore, the apertures 78 can be oriented on the sprayers 54 to emit a spray of wash liquid in different directions, when viewed from the front as shown in FIG. 12 or when viewed from the side as shown in FIG. 13. As shown in FIGS. 12 and 13, the apertures can be oriented to spray liquid substantially horizontally as indicated by A, laterally outwardly toward one side of the dish rack 26 as indicated by B, laterally outwardly toward an opposite side of the dish rack 26 as indicated by C or at an upwardly angle as indicated by D. While not shown, the apertures 78 can also be oriented to spray liquid at a downward angle. The coverage pattern of the apertures 78 shown herein is configured to be a suitable for larger utensil items, specifically a 9"×13" dish or pan P. Other coverage patterns suitable for other utensil items are also possible. It is noted that the lines A, B, C, and D in FIGS. 12 and 13 represent the center line for the spray emanating from the corresponding aperture 78. In reality, the emanating spray will fan out, typically in a cone-shaped pattern, about the corresponding centerline.

Figure 14:
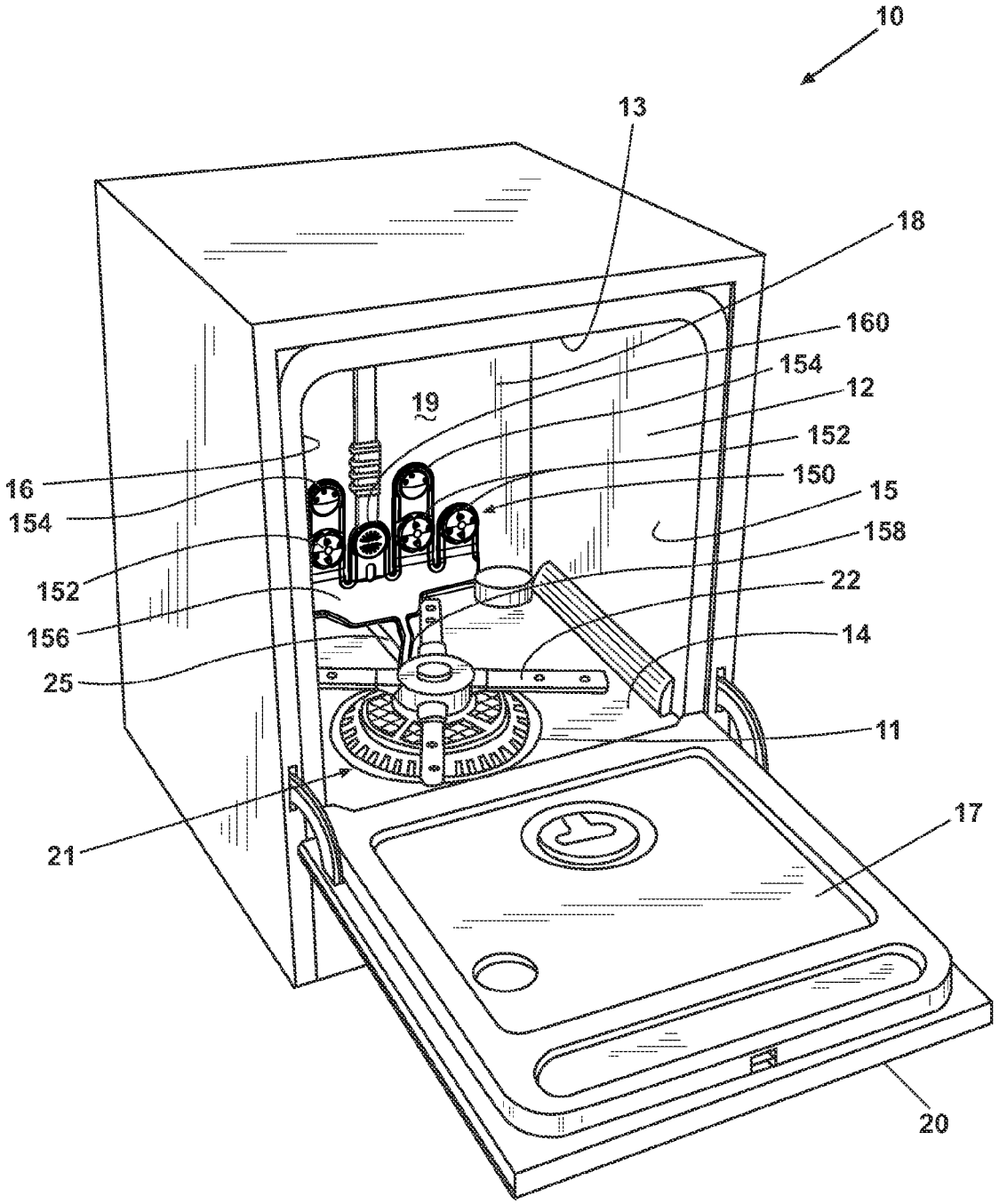
FIG. 14 is a perspective view of a dishwasher having a spray manifold in accordance with a third embodiment of the present invention.

FIG. 14 is a perspective view of a dishwasher 10 having a spray manifold 150 in accordance with a third embodiment of the present invention. The dishwasher 10 can be substantially similar to the dishwasher 10 shown in FIG. 1, with the exception the spray manifold 150 is employed in place of the spray manifold 29.

The spray manifold 150 comprises multiple sprayers 152, 154 through which liquid is sprayed into the wash chamber 19. The sprayers include one or more rotating sprayers 152 and one or more stationary sprayers 154. The sprayers 152, 154 are fluidly coupled to a common liquid distribution header 156. A supply conduit 158 supplies liquid to the spray manifold 150 from a liquid source and is fluidly coupled to the liquid distribution header 156. A bracket 160 positioned between the sprayers 152, 154 is used to couple the spray manifold 150 to the tub 12, and can extend around the supply tube 25 to secure to the spray manifold 150 to the rear wall 18 of the tub 12.

Figure 15:
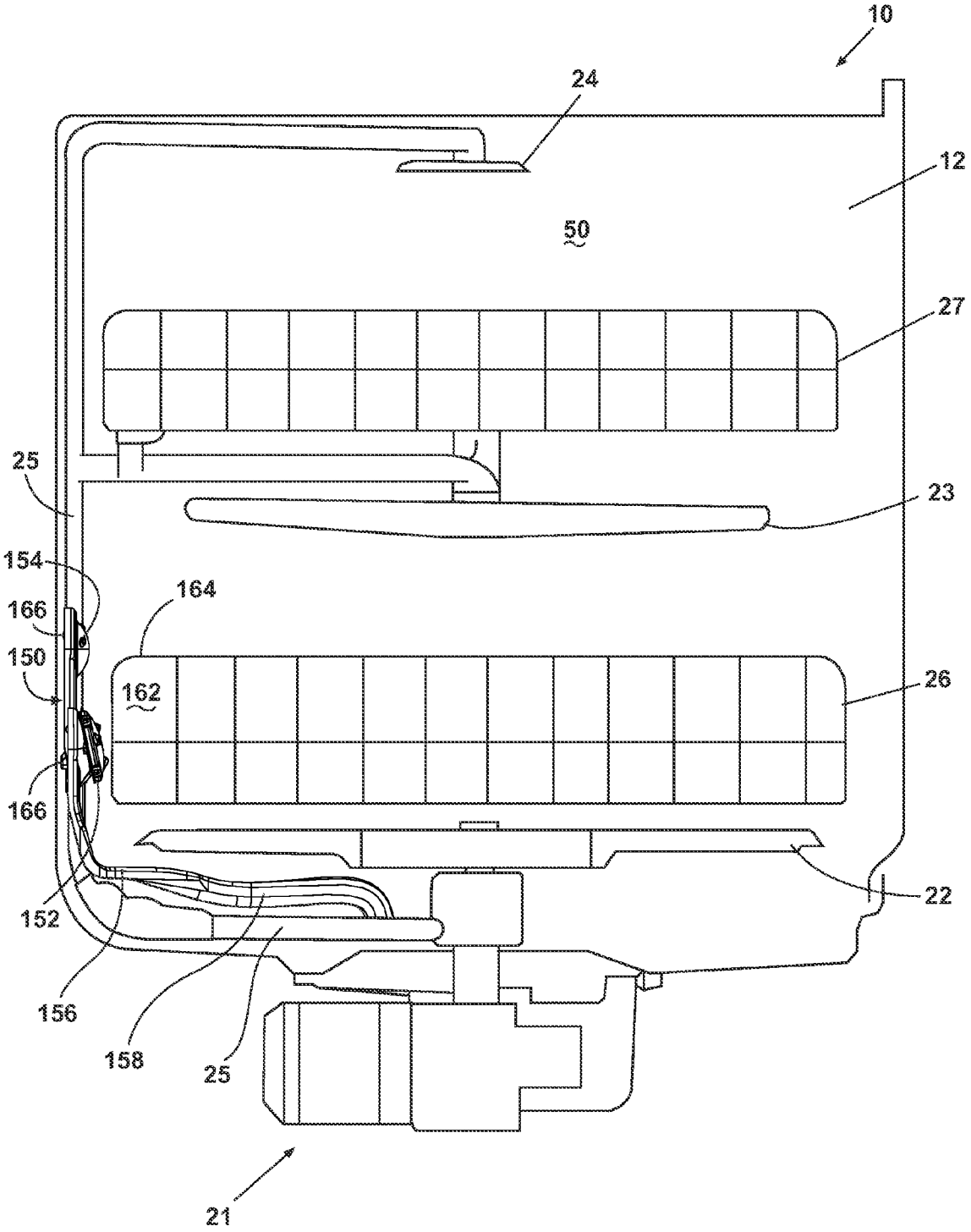
FIG. 15 is a schematic, cross-sectional view of the dishwasher shown in FIG. 13.

FIG. 15 is a schematic, cross-sectional view of the dishwasher 10 shown in FIG. 13. The spray manifold 150 can be positioned adjacent the rear wall 18 of the interior tub 12 adjacent the lower dish rack 26. In this way, a flow of wash liquid is directed toward the lower dish rack 26 from the manifold thereby providing a second utensil or wash zone 162. Like the first embodiment, the first wash zone 50 is provided by the spray of wash liquid from any one or combination of the spray arm assemblies 22, 23, 24. The spray manifold 150 can extend in generally horizontal manner across a partial width of the lower dish rack 26. However, the spray manifold 150 may extend across virtually any width of the rack 26 or tub 12. Furthermore, one or more of the multiple sprayers 152, 154 can extend above an upper edge 164 of the lower dish rack 26 such that the sprayers 152, 154 not only spray through the side of the lower dish rack 26, but also across the top of the lower dish rack 26. As shown herein, the rotating sprayers 152 are positioned to spray through the side of the lower dish rack 26, while the stationary sprayers 154 are positioned to spray across the top of the lower dish rack 26. The position of the spray manifold 150 shown, particularly the sprayers 152, 154 provided both below and above the upper edge 164 of the lower dish rack 26, allows for casserole dishes or 9"×13" pans to be loaded into the lower dish rack 26 in an upright position, which helps maximize or optimize amount of dishware that can be loaded in any given cycle while still effectively cleaning the casserole dish or 9"×13" pan.

The spray manifold 150 can include at least one spacer 166 that provides a gap between the rear side of the spray manifold 150 and the rear wall 18 of the tub 12. As shown, multiple spacers 166 are provided on the spray manifold 150. The gap created by the spacers 166 permits some wash liquid to flow between the spray manifold 150 and the tub 12, which rinses soil out of the gap and prevents the accumulation of soil behind the spray manifold 150.

Like the second embodiment, the third embodiment of the spray manifold 150 is configured to receive wash liquid from a separate and dedicated supply conduit 158. Therefore, rather than being in fluid communication with the supply tube 25 that provides liquid to either or both of the mid-level and upper spray arm assemblies 23, 24, as in the first embodiment, the spray manifold 150 receives liquid via its own supply conduit 158 that extends along the bottom wall of the tub 12 to the liquid distribution header 156. While not shown herein, the dishwasher 10 of the third embodiment can employ the liquid supply system shown in FIG. 7A and the valve mechanism 350 shown in FIG. 7A can be provided such that only one of the supply tube 25 and supply conduit 158 can receive liquid at one time. In an alternate configuration, liquid can be supplied to the supply tube 25 and supply conduit 158 at the same time. In another configuration, the valve 40 disclosed above for the first embodiment can be used to divert wash liquid between the supply tube 25 and the supply conduit 158.

Figure 16:
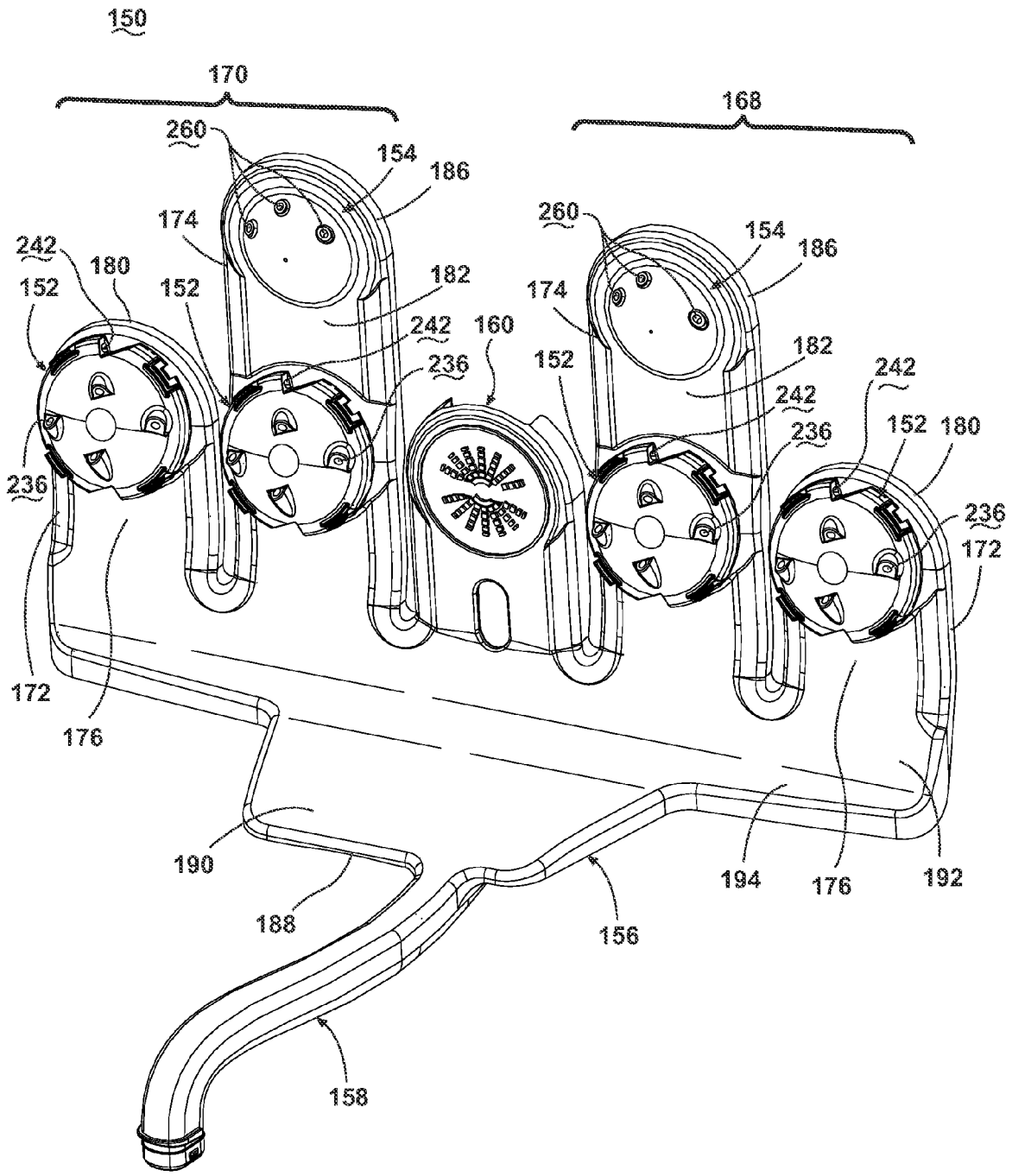
FIG. 16 is a front perspective view of the spray manifold from FIG. 13.
Figure 17:
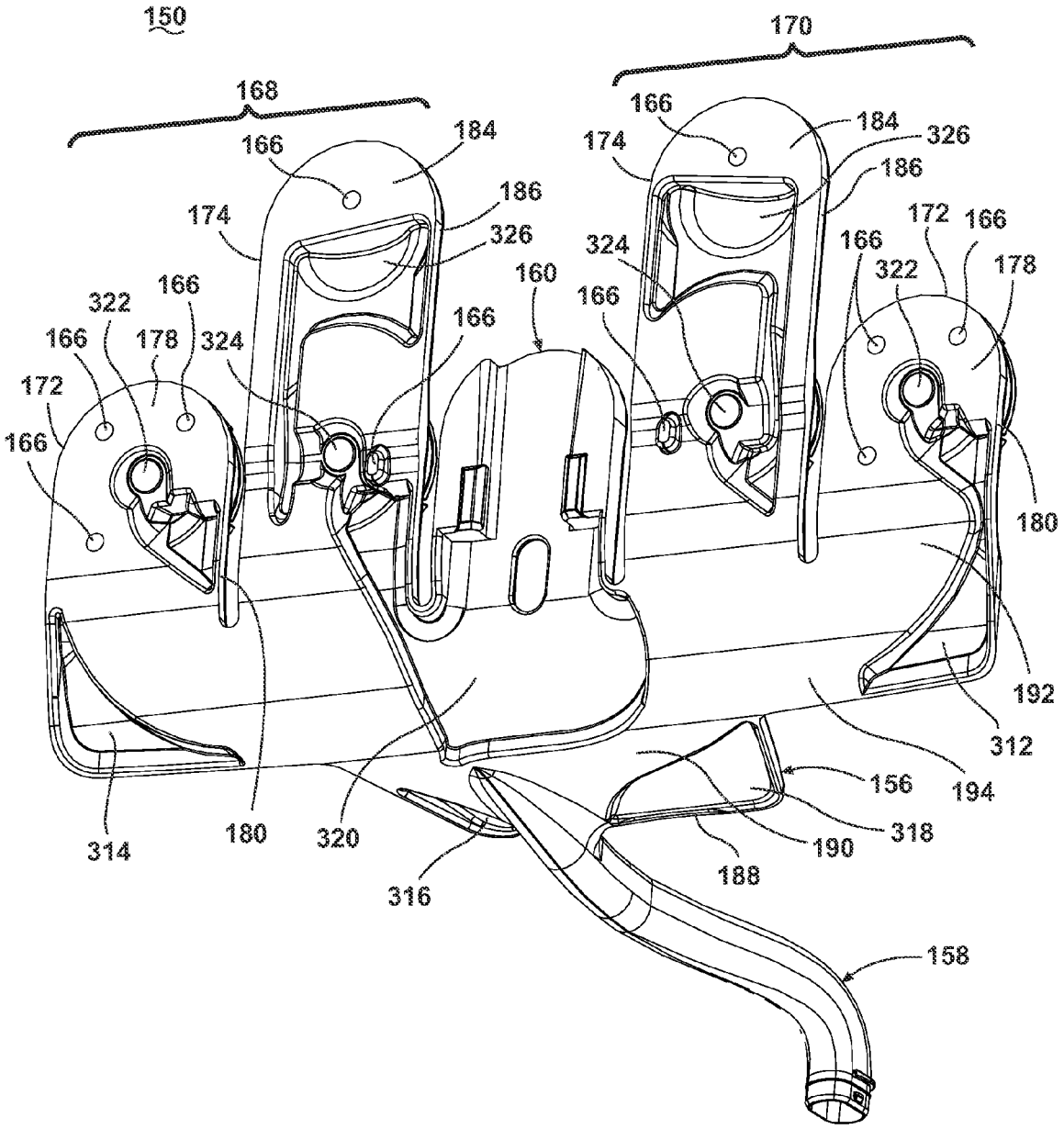
FIG. 17 is a rear perspective view of the spray manifold from FIG. 13.

FIGS. 16 and 17 are front and rear perspective views of the spray manifold 150 from FIG. 14. As shown, the spray manifold 150 is configured to have two branches, a right branch 168 and a left branch 170 as viewed from the perspective of a user standing in front of and facing the open dishwasher 10 of FIG. 14, which selectively receive liquid being pumped through the supply conduit 158. As shown, the two branches 168, 170 may be symmetrically opposing and may be positioned opposite sides of the bracket 160. The branches 168, 170 are further positioned on opposite sides of the supply conduit 158, but unlike the position of the branches 168, 170 with respect to the bracket 160, are not symmetrically positioned with respect to the supply conduit 158. In the illustrated configuration, the right branch 168 is closer to the supply conduit 158 than the left branch 170. Alternatively, the branches 168, 170 may be non-symmetrical and/or may be provided on the same side of the bracket 160 and/or supply conduit 158.

Each branch 168, 170 is in fluid communication with the liquid distribution header 156 and is provided with one or more of the multiple sprayers 152, 154 of the spray manifold 150. As shown herein, each branch 168, 170 is provided with two rotating sprayers 152 and one stationary sprayer 154. It is also within the scope of the invention for each branch 168, 170 to be provided with a different or non-equal number of sprayers 152, 154.

As illustrated, each branch has a shorter lateral body 172 and a longer medial body 174 extending upwardly from the liquid distribution header 156 to a free upper end. The lateral body 172 is generally flat and has an inner surface 176 that faces the wash chamber 19 and an outer surface 178 that faces the rear wall 18 of the tub 12 and which is joined to the inner surface 176 by a narrow peripheral side surface 180 that extends around three sides of the body 172. The medial body 174 is generally flat and has an inner surface 182 that faces the wash chamber 19 and an outer surface 184 that faces the rear wall 18 of the tub 12 and which is joined to the inner surface 182 by a narrow peripheral side surface 186 that extends around three sides of the body 174. The lateral body 172 comprises one rotating sprayer 152 provided in its inner surface 176, while the medial body 174 comprises one rotating sprayer 152 and one stationary sprayer 154 provided on its inner surface 182. The outer surfaces 178, 184 of the lateral and medial bodies 172, 174 can include at least one of the spacers 166; as shown, multiple spacers 166 are provided on the outer surface 178, 184 of each body 172, 174, and can be arranged as an array of raised protrusions on the outer surface 178, 184.

The liquid distribution header 156 has a generally L-shaped body 188 having a lower portion 190 that extends outwardly from the supply conduit 158 and an upper portion 192 which extends to the sprayers 152, 154. The lower portion 190 extends generally horizontally and is configured to extend along the bottom wall 14 of the tub 12 (FIG. 6). The upper portion 192 extends generally vertically and is configured to extend along the rear wall 18 of the tub 12 (FIG. 6). The lower and upper portions 190, 192 are joined together by a curved portion 194 which extends over the corner between the bottom and rear walls 14, 18 (FIG. 6). As shown in FIG. 16, the upper surface of the header body 188 can be relatively smooth and without surface features while as shown in FIG. 17, the lower surface of the header body 188 can have surface features which designate the flow paths of liquid through the liquid distribution header 156.

Figure 18:
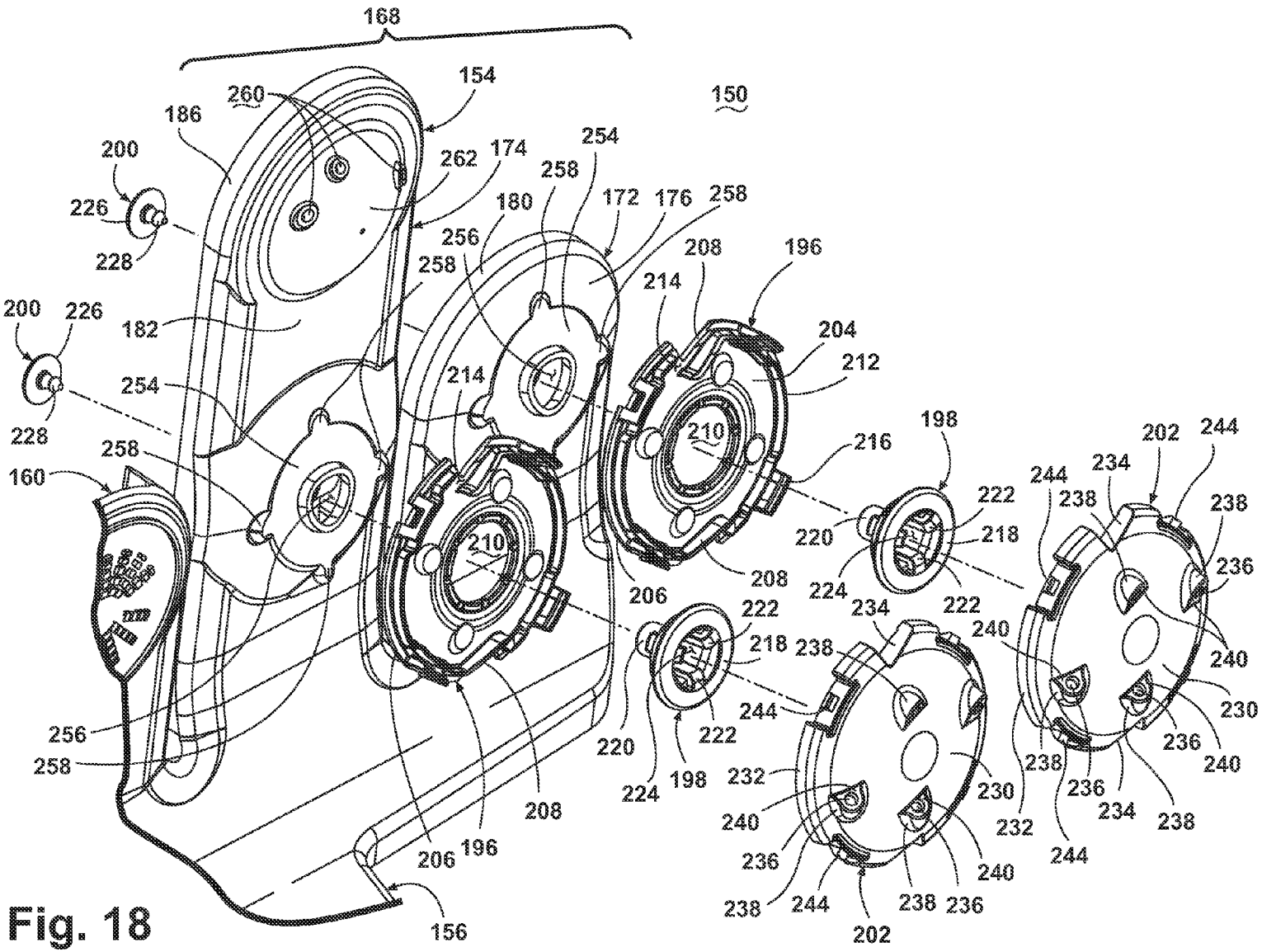
FIG. 18 is an exploded view of a portion of the spray manifold from FIG. 13, illustrating the components of a rotating sprayer of the spray manifold.

FIG. 18 is an exploded view of the right branch 168 of the spray manifold 150, illustrating the components of the rotating sprayers 152. Each rotating sprayer 152 includes a spray head having a rear sprayer body 196, a hub 198 which couples the rear sprayer body 196 to the sprayer bodies 172, 174, a retainer 200 which retains the hub 198 on the branch bodies 172, 174, and a front sprayer body comprising a cap 202 mounted to the front of the rear sprayer body 196.

The rear body 196 comprises a rear surface 204 and a peripheral side surface 206 that is generally circular in shape, with the exception of two notched sections 208. The rear surface 204 includes a central opening 210 and a guide wall 212 spaced inwardly of the peripheral side surface 206 that extends along the majority of the peripheral side surface 206, with the exception of breaks or openings 214 provided in alignment with the notched sections 208. The peripheral side surface 206 is provided with one or more coupling features, shown herein as spaced resilient tabs 216.

The hub 198 includes a body having a radially extending flange 218 on one end and which is joined to a female connector 220 by a frame 222 extending from the flange 218 to the female connector 220. The frame 222 includes one or more openings 224 which permit the passage of liquid into the rotating sprayer 152.

The retainer 200 includes a head 226 attached to a male connector 228 which is received by the female connector 220 on the hub 198. The male and female connectors 228, 220 can be configured for a friction or interference fit fastening.

The cap 202 comprises a front surface 230 and a peripheral side surface 232 that is generally circular in shape, with the exception of two notched sections 234.

The cap 202 includes a plurality of primary apertures 236 configured to spray wash liquid outwardly from the cap 202. The front surface 230 of the cap 202 can include raised protrusions 238 having an angled face 240 in which the apertures 236 are formed. Each aperture 236 may be substantially circular in shape, although other shapes, such as oval, are possible. The angled faces 240, and, thus, the apertures 236, can be oriented in different directions; as shown herein, the faces 240 are arranged in opposing pairs, such that the spray of liquid from the apertures 236 covers a wider area.

Figure 19:
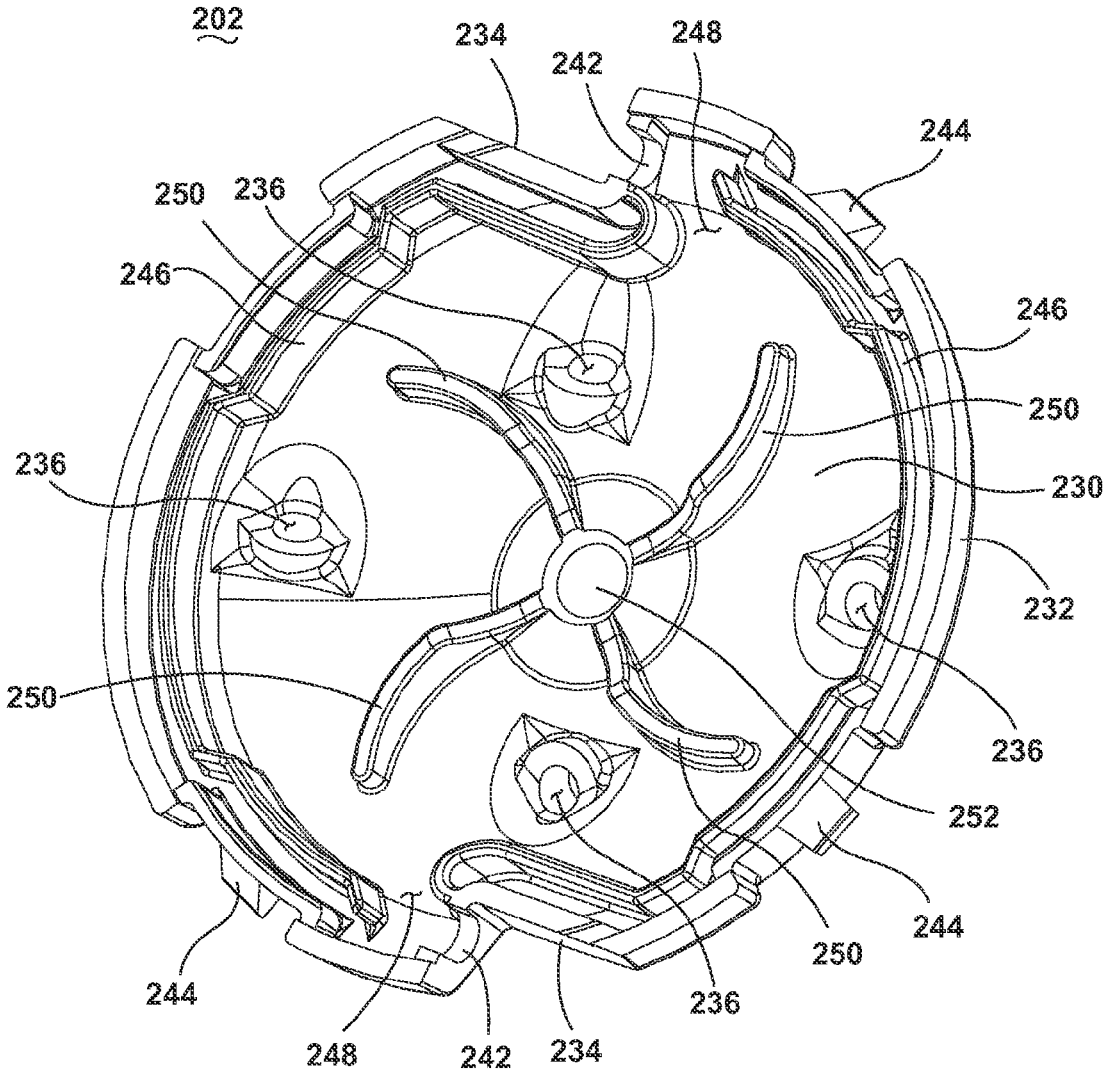
FIG. 19 is a rear view of a cap for the rotating sprayer shown in FIG. 18.

FIG. 19 is a rear view of the cap 202. The cap 202 can further include a plurality of secondary apertures 242 configured to spray liquid peripherally from the cap 202. The secondary apertures 242 are formed in the notched sections 234 of the peripheral side surface 232. Two secondary apertures 242 can be provided, and can be diametrically opposing such that the apertures 242 spray in opposite directions and produce a driving force to rotate the sprayer 152.

The cap 202 further includes a guide wall 246 spaced inwardly of the peripheral side surface 232 that extends along the majority of the peripheral side surface 232, with the exception of breaks or openings 248 provided in alignment with the notched sections 234. The guide wall 246 of the cap 202 can be aligned with the guide wall 212 on the rear body 196 (FIG. 18). The inner surface of the cap 202 can comprise a plurality of spaced guide vanes 250 that radiate from a central portion 252. As shown herein, the guide vanes 250 can extend between adjacent apertures 236 and can be oriented to deflect liquid toward the apertures 236.

Referring back to FIG. 18, the peripheral side surface 232 is further provided with one or more complementary coupling features, shown herein as spaced detents 244 that are received by the tabs 216 for attaching the cap 202 to the rear body 196, thereby defining a fluid chamber between the cap 202 and rear body 196, the fluid chamber having an inlet provided by the central opening 210 of the rear body 196 and an outlet provided by the primary and secondary apertures 236, 242 in the cap 202. When attached, the peripheral side surfaces 206, 232 and notched sections 208, 234 of the rear body 196 and cap 202 are mated.

The inner surfaces 176, 182 of the lateral and medial bodies 172, 174 each include a raised platform 254 on which the rotating sprayers 152 are mounted. The platform 254 can include a central opening 256 in fluid communication with the central opening 210 of the rear body 196, and at least one spacer 258 that provides a gap between the rear side of the rotating sprayer 152 and the platform 254. As shown, multiple spacers 258 are provided on the platform 254. The gap created by the spacers 258 permits some wash liquid to flow between the rotating sprayer 152 and the platform 254, which rinses soil out of the gap and prevents the accumulation of soil behind the rotating sprayer 152.

The stationary sprayer 154 is provided above the rotating sprayer 152, and includes a plurality of apertures 260 configured to spray wash liquid outwardly. The inner surface 182 of the medial body 174 includes a raised circular protrusion 262 in which the apertures 260 are formed. The apertures 260 can be a mixture of oval and circular openings, although other shapes are possible. As one of skill in the art will appreciate, the liquid being pumped through the supply conduit 158 can be under pressure as it passes through the various apertures 236, 242, 260 of the rotating and stationary sprayers 152, 154, thereby, creating an intensified wash zone. The spray from the apertures collectively define the spray zone 162 directed toward the lower dish rack 26 shown in FIG. 15.

The stationary sprayers 154, liquid distribution header 156, supply conduit 158, and bracket 160 can be integrally formed together as a single molded piece. The rotating sprayers 152 can be separately formed and mounted to the spray manifold 150. Alternatively, one or more of the other components of the spray manifold 150 can be formed separately and physically coupled together, using suitable sealing means as needed to create a fluid-tight spray manifold 150.

Figure 20:
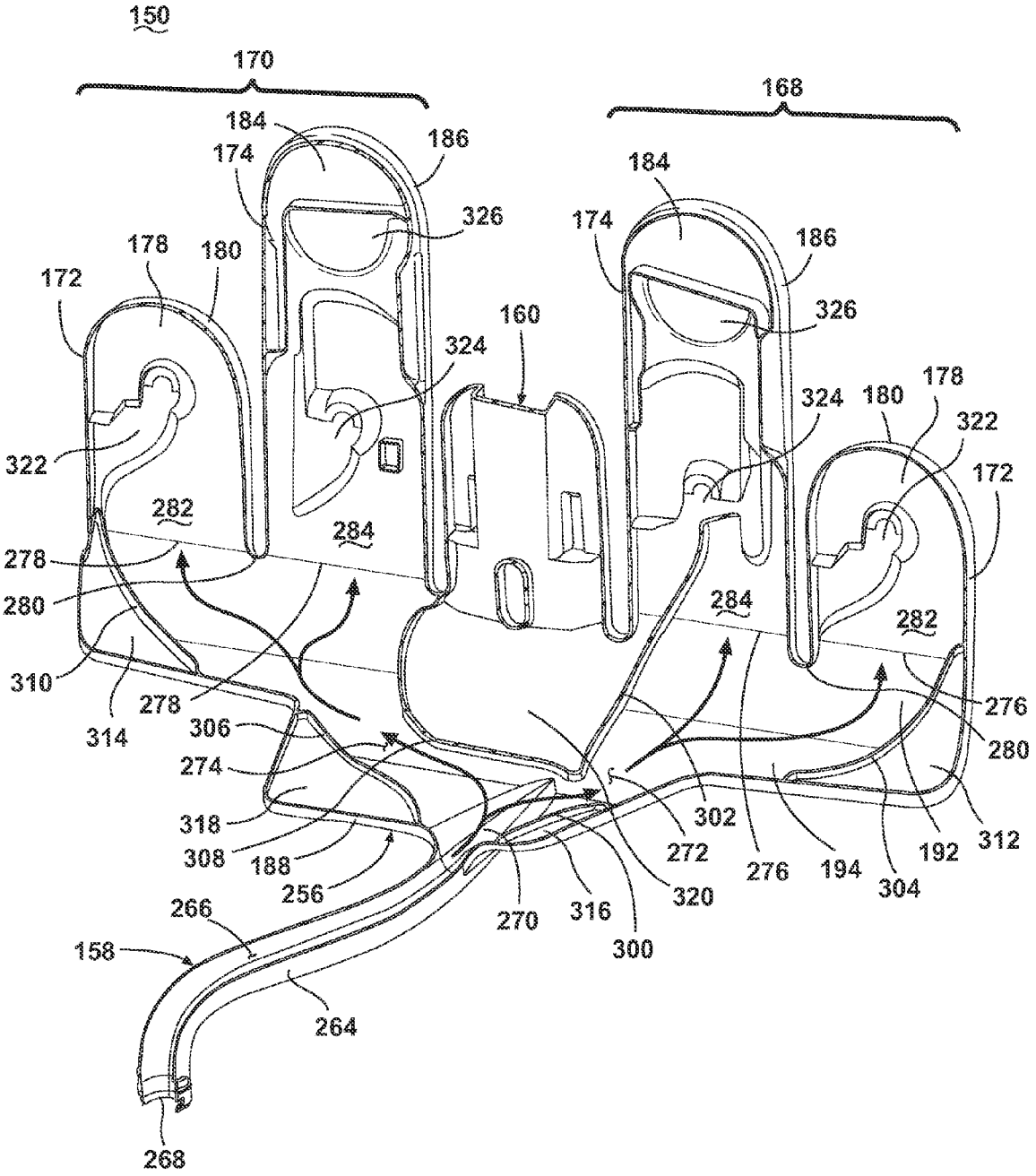
FIG. 20 is a front perspective view of the spray manifold from FIG. 14, with a portion of the spray manifold cut away to illustrate the liquid flow paths through the spray manifold.

FIG. 20 is a front perspective view of the spray manifold 150, with a portion of the spray manifold 150 cut away to illustrate the liquid flow paths through the spray manifold 150. Specifically, many of the upper and inner surfaces of the spray manifold 150 are removed for clarity. The supply conduit 158 comprises an elongated tube 264 defining an interior supply flow path 266 having a first end defining an inlet 268 of the interior supply flow path 266 in fluid communication with a liquid source, such as the sump 11, and a second end which joins the liquid distribution header 156 and defines an outlet 270 of the interior supply flow path 266.

The liquid distribution header 156 defines an interior flow path having multiple channels 272, 274 that deliver wash liquid from the supply conduit 158 to the branches 168, 170. The number of channels can correspond to the number of branches, with each of the channels in fluid communication with one corresponding branch. Since the illustrated embodiment has a right and left branch 168, 170, the liquid distribution header 156 has a corresponding right channel 272 and left channel 274. The channels 272, 274 can have a common inlet, namely, the outlet 270 of the supply conduit 158. However, each channel 272, 274 has its own outlet 276, 278, respectively, thereby, fluidly isolating the two branches 168, 170 from each other. The outlet can be formed by multiple separate openings, which can correspond to the number of sprayer bodies 172, 174 for each branch 168, 170. Since the illustrated embodiment has two sprayer bodies 172, 174 per branch 168, 170, the outlet of each channel 272, 274 will have two openings 276, 278. The openings 276, 278 on each branch 168, 170 can be separated from each other by a divider 280 connecting the peripheral side surfaces 180, 186 of the adjacent sprayer bodies 172, 174.

Likewise, each branch 168, 170 defines an interior flow path having multiple passageways 282, 284 that deliver wash liquid from the liquid distribution header 156 to the various apertures 236, 242, 260 of the rotating and stationary sprayers 152, 154. The number of passageways 282, 284 can correspond to the number of sprayer bodies 172, 174, with each of the lateral passageways 282 in fluid communication with the lateral sprayer bodies 172 and the medial passageways 284 in fluid communication with the medial sprayer bodies 174. Since the illustrated embodiment has one lateral and one medial sprayer body 172, 174 for each branch 168, 170, each branch 168, 170 has one corresponding lateral and one corresponding medial passageway 282, 284. The passageways 282, 284 can have a common inlet, namely, the outlet openings 276 or 278 of the channels 272, 274. However, each passageway 282, 284 has its own outlet, with the lateral passageway 282 having the apertures 236, 242 of the rotating sprayer 152 as outlets, and the medial passageway 284 having the apertures 236, 242 of the rotating sprayer 152 as well as the apertures 260 of the stationary sprayer as outlets (see FIG. 16). Thus, the sprayers 152, 154 on different sprayer bodies 172, 174 are fluidly isolated from each other. In the illustrated embodiment, the two lateral passageways 282 are similar to each other, and can, therefore, have the same cross-sectional area as each other. Likewise, the medial passageways 284 are similar to each other, and can therefore have the same cross-sectional areas as each other.

Figure 21:
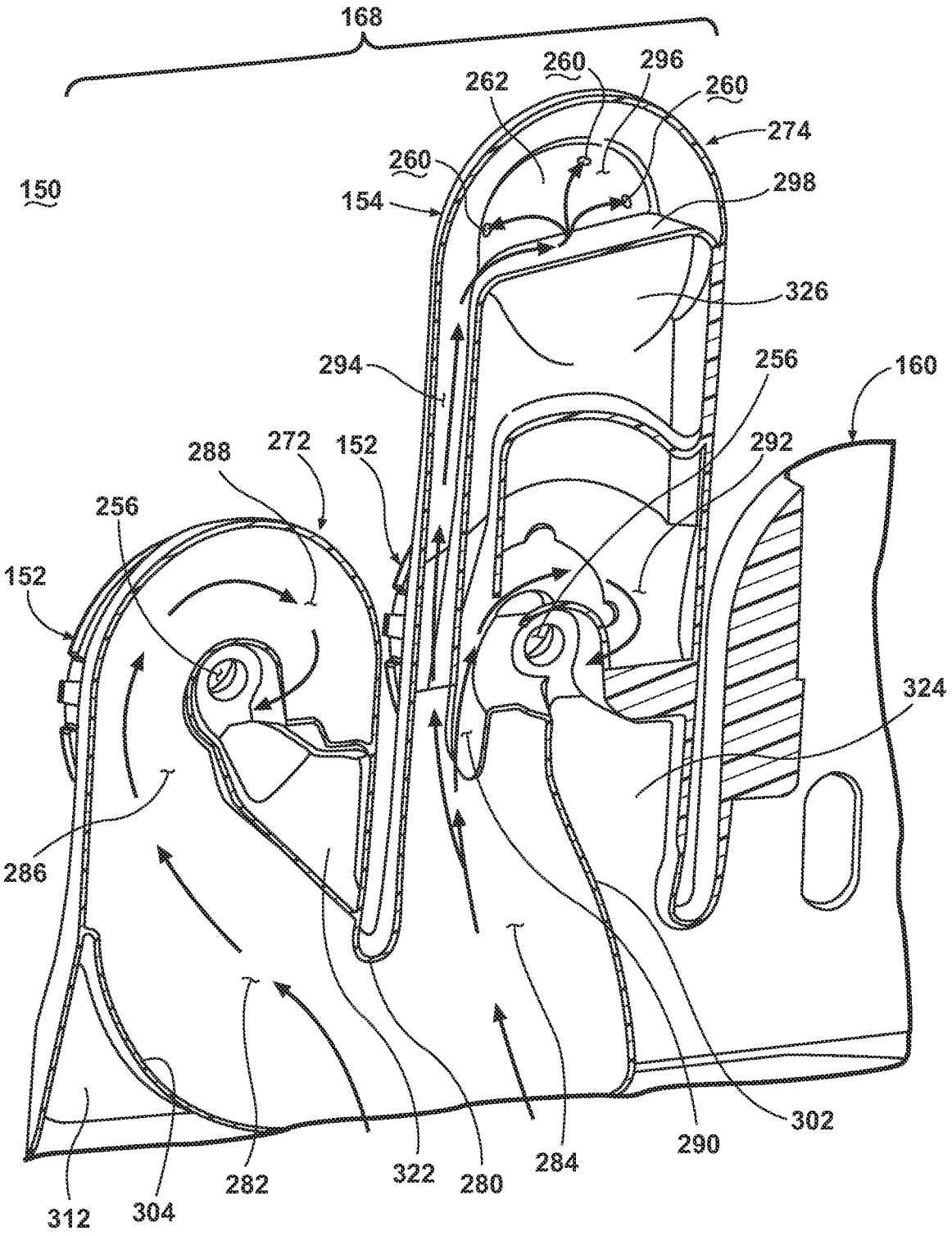
FIG. 21 is a rear perspective view of a portion of the spray manifold from FIG. 14, with a portion of the spray manifold cut away to illustrate the liquid flow paths through the spray manifold.

FIG. 21 is a rear perspective view of the right branch 168 of the spray manifold 150, with a portion of the spray manifold 150 cut away to illustrate the liquid flow paths through the spray manifold 150. Specifically, many of the rear surfaces of the spray manifold 150 are removed for clarity. In the illustrated embodiment, the liquid flow paths through each branch 168, 170 will be similar. Each lateral passageway 282 can have a sickle shaped path, with an angled proximal portion 286 and a curved distal portion 288 that terminates in an outlet defined by the central opening 256 in the lateral body 172. Thus, incoming liquid to the rotating sprayer 152 is directed in a swirling pattern toward the central opening 256.

Each medial passageway 284 has a dual path for supplying liquid to both the rotating sprayer 152 and the stationary sprayer 154. The first path, which supplies the rotating sprayer 152, can be sickle shaped, with an angled proximal portion 290 and a curved distal portion 292 that terminates in an outlet defined by the central opening 256 in the medial body 174. The second path, which supplies the stationary sprayer 154, can extend as an offshoot from the first path, and can include a vertical passageway 294 which opens into a cavity 296 in which the apertures 260 are provided. The cavity 296 can be semi-hemispherical in shape, formed by a flat bottom wall 298 provided at approximately the middle of the circular protrusion 262 in which the apertures 260 are provided The tube 264, channels 272, 274, and passageways 282, 284 can collectively define multiple liquid flow paths through the spray manifold 150. A liquid flow path through the spray manifold 150 can be thought of as the flow path of liquid traveling from the supply conduit 158 to one of the sprayers 152, 154. Thus, the spray manifold 150 shown herein comprises six distinct liquid flow paths. Under a narrower classification, a liquid flow path through the spray manifold 150 can be thought of as the flow path of liquid traveling from the supply conduit 158 to one of the apertures 236, 242, 260 of the sprayer manifold 150. Using this classification, the spray manifold 150 shown herein comprises thirty distinct liquid flow paths since thirty apertures 236, 242, 260 are provided on the spray manifold 150.

The interior flow path of the liquid distribution header 156 can be configured to minimize pressure loss from the inlet to the channels 272, 274, to the branches 168, 170. The embodiment of the invention shown herein employs multiple techniques for minimizing pressure loss. First, the interior flow path of the liquid distribution header 156 can be configured to lack any sharp transitions between the channel 272, 274 and its associated branch 168, 170 to reduce or eliminate any areas of turbulent flow in the interior flow path. The reduction or elimination of turbulent flow within the liquid distribution header 156 can help minimize pressure loss in the spray manifold 150.

As shown in FIG. 20, the channels 272, 274 are formed by a combination of straight, curved and angled walls which guide the flow of liquid through the channel 272, 274 to the associated branch 168, 170. Specifically, the right channel 272 includes an outer wall 300 and an inner wall 302, both of which can include smooth transitions along their respective lengths. The outer wall 300 can eventually merge with the peripheral side surface 180 of the lateral sprayer body 172 on the right branch 168, while the inner wall 302 can extend upwardly into the medial sprayer body 174 to define a portion of the medial passageway 284. The outer wall 300 can include a rounded corner 304 that directs liquid toward the lateral sprayer body 172. Furthermore, the divider 280 that separates the outlet openings 276 of the right channel 272 can be rounded as well.

The left channel 274 includes an outer wall 306 and an inner wall 308, both of which can include smooth transitions along their respective lengths. The outer wall 306 can eventually merge with the peripheral side surface 180 of the lateral sprayer body 172 on the left branch 170, while the inner wall 308 can likewise eventually merge with the peripheral side surface 186 of the medial sprayer body 174 on the left branch 170. The outer wall 306 can also include a rounded corner 310 that directs liquid toward the lateral sprayer body 172. Furthermore, the divider 280 that separates the outlet openings 278 of the left channel 274 can be rounded as well.

The rounded corners 304, 310 of each channel 272, 274 can be formed by depressing sections of the curved portion 194 of the liquid distribution header 156, which eliminates the otherwise sharp transitions created by the outer corners of the liquid distribution header 156. As shown, both corners of the curved portion 194 are depressed to seal them against liquid flow, thereby, forming a right upper sealed corner 312 adjacent the right channel 272 and a left upper sealed corner 314 adjacent the left channel 274. Thus, while the outer profile of the spray manifold 150 may include sharp transitions and corners, the interior flow path through the spray manifold 150 can be configured to eliminate these sharp transitions and corners.

The liquid distribution header 156 can include additional depressed sections which define the shape of the channels 272, 274. As shown in FIG. 20, the corners of the lower portion 190 of the liquid distribution header 156 are depressed to seal them against liquid flow, thereby forming a right lower sealed corner 316 which defines a portion of the outer wall 300 of the right channel 272 and a left lower sealed corner 318 which defines a portion of the outer wall 306 of the left channel 274. At least a portion of the inner walls 302, 308 of the channels 272, 274 can be defined by depressing a central portion of the header body 188 to seal this area against liquid flow, thereby forming a central sealed area 320 in the liquid distribution header 156.

The passageways 282, 284 can also be configured to lack any sharp transitions to reduce or eliminate any areas of turbulent flow in the interior flow paths of the sprayer bodies 172, 174. The reduction or elimination of turbulent flow within the sprayer bodies 172, 174 can also help minimize pressure loss in the spray manifold 150. The branches 168, 170 can include additional depressed sections which define the shape of the passageways 282, 284. The passageways 282, 284 can be formed by a combination of straight, curved and angled walls which guide the flow of liquid through the passageways 282, 284 to the associated sprayers 152, 154. As shown in FIGS. 20 and 21, the lateral sprayer bodies 172 have irregularly-shaped depressions that are sealed against liquid flow, thereby, forming lateral sealed areas 322 that define the sickle shape of the lateral passageways 282. The medial sprayer bodies 174 have irregularly-shaped depressions that are sealed against liquid flow, thereby forming lower and upper medial sealed areas 324, 326 that define the dual paths of the medial passageways 284.

A second technique employed by the embodiment of the spray manifold 150 shown in the figures for minimizing pressure loss is to configure the interior flow path of the liquid distribution header 156 such that the volumetric flow rate requirement of each channel 272, 274 corresponds to or matches that of its associated sprayers 152, 154. Each sprayer 152, 154 has a predetermined minimum volumetric flow rate requirement for producing a continuous or near-continuous spray of liquid. If liquid is supplied to one of the sprayers 152, 154 below its required volumetric flow rate, the spray of liquid produced by the sprayer can sputter intermittently, which reduces the cleaning effect of the spray manifold 150.

In embodiments where the sprayers 152, 154 are organized on different branches, such as in the illustrated embodiment where two rotating sprayers 152 and one stationary sprayer 154 are provided per branch 168, 170, the volumetric flow rate requirement of each branch 168, 170 can correspond directly to the volumetric flow rate requirements of the sprayers 152, 154 provided on each branch 168, 170; more specifically, the volumetric flow rate requirement of each branch 168, 170 will be approximately the sum of the volumetric flow rate requirements of the sprayers 152, 154 provided thereon. In this case, the interior flow path of the liquid distribution header 156 can be configured such that the volumetric flow rate requirement of each channel 272, 274 corresponds to or matches that of its associated branch 168, 170.

The volumetric flow rate through each portion of the spray manifold 150, whether it be one of the sprayers 152, 154, one of the branches 168, 170, or one of the channels 272, 274, may be quantified as a function of the volume of liquid which passes through a given cross-sectional area of the portion and the velocity of the liquid flowing through the portion. In this case, since liquid is supplied to the spray manifold 150 from a common source, i.e. from the supply conduit 158, the velocity of the liquid flowing through each portion of the spray manifold 150 will be about equal. However, the rotating and stationary sprayers 152, 154 have different cross-sectional areas and may accommodate unequal volumes of liquid. Additionally, since the medial sprayer bodies 174 supply both a rotating sprayer 152 and a stationary sprayer 154 while the lateral sprayer bodies 172 supply only a rotating sprayer, a greater volume of liquid should be supplied to the medial sprayer bodies 174 than the lateral sprayer bodies 174.

The channels 272, 274 may have the same cross-sectional area since each feeds an equal number of identical sprayers 152, 154. However, the cross-sectional area of the liquid flow paths through the channels 272, 274 in the location of the liquid distribution header 56 may be different for each channels 272, 274. Furthermore, the inlet and outlet of the interior flow path of the liquid distribution header 156 can have equal cross-sectional areas.

Due to the off-center placement of the supply conduit 158 with respect to the liquid distribution header 156, proper distribution of liquid to the sprayers 152, 154 in order to meet their respective volumetric flow rate requirements can be problematic. The liquid distribution header 156 can comprise a flow diverter 328 for proportionally dividing the liquid supplied from the supply conduit 158 to the multiple sprayers 152, 154 in proportion to the volumetric flow rate requirement of each sprayer 152, 154. The flow diverter 328 can be a stationary formation in the liquid distribution header 156 that is positioned in opposing relationship to the outlet opening 270 of the supply conduit 158. The flow diverter 328 can be located to proportionally divide the cross-sectional area of the outlet opening 270 in correspondence with the volumetric flow rate requirement of the sprayers 152, 154. In the illustrated embodiment, since the outlet opening 270 is positioned closer to the right branch 168 than the left branch 170, a greater amount of incoming liquid tends to flow toward the right branch 168. However, the flow diverter 328 directs a portion of that liquid back toward the left branch 170 such that the volumetric flow requirements of each branch 168, 170, and, thus, each sprayer 152, 154, are met.

In embodiments where the sprayers 152, 154 are organized on different branches, such as in the illustrated embodiment where two sprayers are provided per branch 168, 170, the flow diverter 328 can proportionally divide the liquid supplied from the supply conduit 158 in proportion to the volumetric flow rate requirement of each branch 168, 170, which is necessarily dependent on the volumetric flow rate requirement of the sprayers 152, 154 provided on each branch 168, 170. The flow diverter 328 can be located to proportionally divide the cross-sectional area of the outlet opening 270 in correspondence with the volumetric flow rate requirement of the two branches 168, 170, i.e. the sum of the volumetric flow rate requirements of each sprayer 152, 154 provided on each branch 168, 170.

Figure 22:
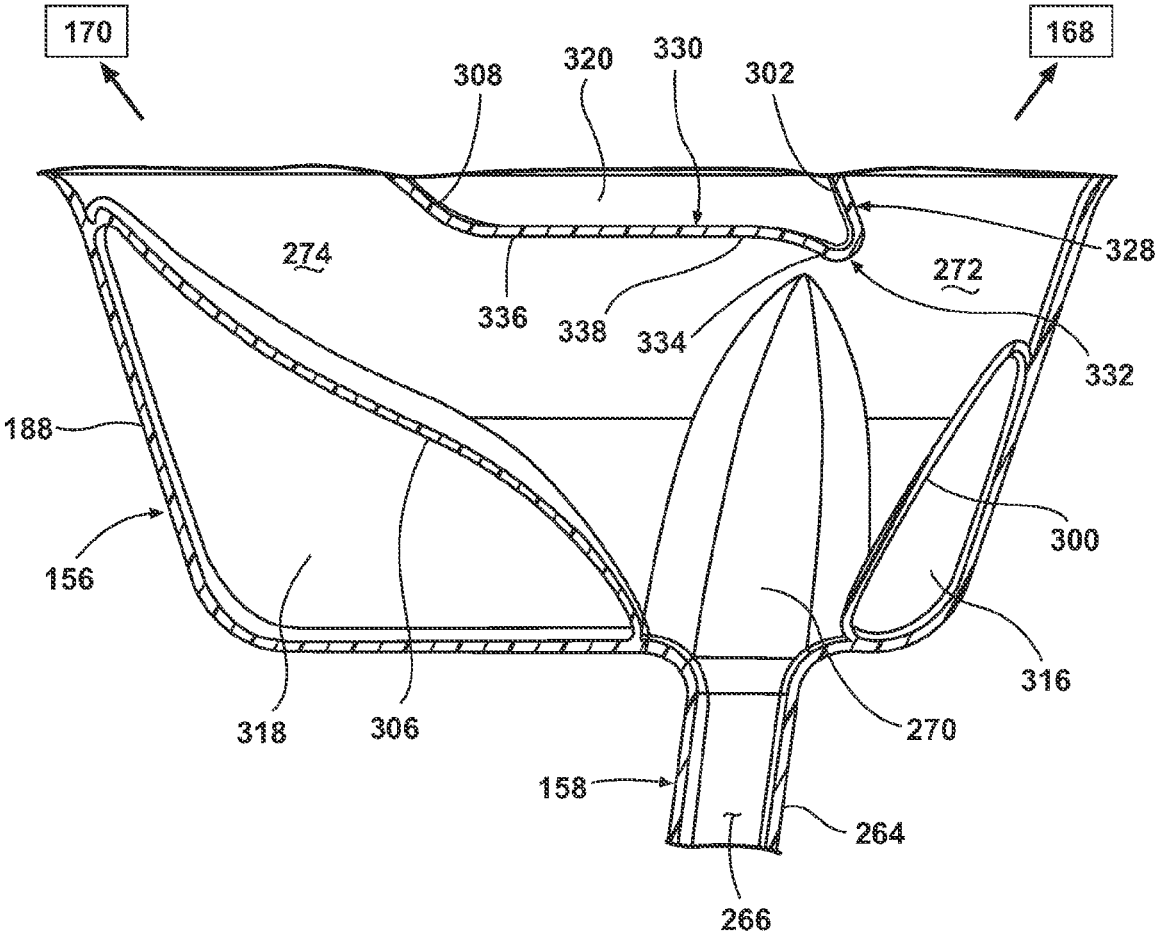
FIG. 22 is a top view of a portion of FIG. 20, illustrating a flow divider provided in the spray manifold.

FIG. 22 is a top view of a portion of FIG. 20, illustrating the flow divider 328. The flow diverter 328 can comprise a deflector wall 330 positioned in opposing relationship to the outlet opening 270 of the supply conduit 158 and a nose 332 from which the deflector wall 330 extends and that is configured to divide the liquid supplied from the supply conduit 158 into two separate flows. As shown herein, the deflector wall 330 is positioned to guide wash liquid to the left branch 170, and can be shaped in accordance with the volumetric needs of the left branch 170. The illustrated deflector wall 330 includes an angled portion 334 extending away from the nose 332 at an incline to the outlet opening 270, a relatively straight portion 336, and a curved transition portion 338 which joins the angled portion 334 with the straight portion 338. The straight portion 336 merges with the inner wall 308 of the left channel 274. The nose 332 merges with the inner wall 302 of the right channel 272.

In operation, as liquid is supplied to the spray manifold 150, due to the off-center placement of the supply conduit 158, a greater amount of incoming liquid tends to flow toward the right branch 168 than the left branch 170. However, the configuration of the liquid distribution header 156 acts to proportionally distribute the liquid to each branch 168, 170 according to the volumetric flow rate requirement of each sprayer 152, 154 on the branch 168, 170. In the illustrated embodiment, the flow diverter 328 directs a portion of the liquid back toward the left branch 170 such that the volumetric flow requirements of each branch 168, 170, and, thus, each sprayer 152, 154, are met. The flow diverter 328 divides the liquid into two flows of liquid, one directed toward the right branch 168 and one directed toward the left branch 170. However, in other embodiments where more than two branches are provided, the liquid distribution header 156 can be configured such that liquid is divided into more than two flows, which may be accomplished, for example, by providing multiple flow diverters 328.

The liquid flow directed toward each branch 168, 170 will be further divided into two flows by the divider 280, a lateral flow directed into the lateral passageway 282 and a medial flow directed toward the medial passageway 284. In the lateral passageway 282, the liquid flow will follow the interior sickle shaped path to the associated rotating sprayer 152, and liquid will be sprayed from the apertures 236, 242 in the rotating sprayer 152. In the medial passageway 282, the liquid flow will be further divided into two flows, one which will follow the first interior sickle shaped path to the associated rotating sprayer 152 such that liquid is sprayed from the apertures 236, 242, and one which will follow the second path to the associated stationary sprayer 154 such that liquid is sprayed from the apertures 260.

The passageways 282, 284 are configured to supply liquid to the rotating sprayers 152 at the same volumetric flow rate. In the illustrated embodiment, since each rotating sprayer 152 has the same configuration, liquid will be emitted from each rotating sprayer 152 at the same flow rate. Likewise, the medial passageways 284 are configured to supply liquid to the stationary sprayers 154 at the same volumetric flow rate. In the illustrated embodiment, since each stationary sprayer 154 has the same configuration, liquid will be emitted from each stationary sprayer 154 at the same flow rate. This in combination with the spray emitted from the rotating sprayers 152 creates a consistent cleaning effect across the spray zone 162 of the spray manifold 150.

Also during operation, liquid may be sprayed from one or more of the spray arm assemblies 22, 23, 24 provided in the treating chamber 19 of FIG. 14. In this manner, multiple spray zones may be created within the treating chamber 19, each associated with one of the spray arm assemblies 22, 23, 24 or with the spray manifold 150, to provide an enhanced cleaning operation.

As one of skill in the art should recognize, the spray manifolds 29, 52, 150 shown herein are not limited to the location within the dishwasher 10 shown in the drawings; rather, the spray manifold 29, 52, 150 could be located in virtually any part of the interior tub 12. For example, the spray manifold 29, 52, 150 could be moved up vertically along any portion of the rear wall 18, such as to a position adjacent the upper dish rack 27. Alternatively, the spray manifold 29, 52, 150 could be positioned underneath the lower dish rack 26, adjacent or beneath the lower spray arm assembly 22. The spray manifold 29, 52, 150 could also be positioned on a different wall of the tub 12, including the top wall 13, the bottom wall 14, either side wall 15, 16, or the front wall 17. Alternatively, the spray manifold 29, 52, 150 can be located within either dish rack 26, 27. Furthermore, the spray manifold 29, 52, 150 can be adjacent to, on, abutting, or integrated with whichever wall or rack of the dishwasher 10 the spray manifold 29, 52, 150 is associated with.

Positioning the spray manifold 29, 52, 150 at different locations within the interior tub 12 of the dishwasher can also affect the direction in which the flow of wash liquid is directed from the spray manifold 29, 52, 150, thereby affecting the location of the second wash zone 28, 62, 162. The spray of liquid from the spray manifold 29, 52, 150 can extend through any portion or portions of either dish rack 26, 27. For example, the spray may travel through any side, including the bottom or top side, of either dish rack 26, 27. In the case of the spray manifold 29, 52, 150 mounted within either dish rack 26, 27, the spray manifold 29, 52, 150 can spray liquid within the interior of the rack 26, 27.

The spray manifolds 29, 52, 150 of the present invention provide the dishwasher 10 with an additional cleaning zone. Existing solutions for providing additional cleaning zones have large pressure losses in the spray devices, which results in low exit velocity of the sprayed liquid and decreased cleaning performance. The decreased cleaning performance can lead to increased cycle times in order to adequately clean utensils. The spray manifolds of the invention, particularly the second and third embodiments 52, 150 shown herein, can reduce or even eliminate pressure loss within the manifold, resulting in higher exit velocities of liquid sprayed from the spray manifold, thereby improving cleaning performance and reducing cycle times. The spray manifolds of the invention, particularly the second and third embodiments 52, 150, accomplish this by configuring the interior flow paths to lack any sharp transitions and/or such that the volumetric flow rate requirement of each sprayer 54, 152, 154 is met.

The foregoing detailed description of the invention has been presented for purposes of illustration and description. It is not intended to be exhaustive nor limit the invention to the precise form disclosed. Many alternatives, modifications and variations have been discussed above, and others will be apparent to those skilled in the art in light of the above teaching.

We claim:

1. A dishwasher comprising:

a tub at least partially forming a treating chamber;

a dish rack provided within the treating chamber and defining a utensil zone in which utensils are received for washing; and a spray manifold provided within the treating chamber and having multiple apertures though which liquid is emitted to define a first spray zone directed toward the utensil zone, the spray manifold comprising:

multiple branches, each branch supplying liquid to at least one of the apertures;

a liquid distribution header defining an interior flow path having an inlet from which extends multiple channels corresponding to the multiple branches, with each of the channels in fluid communication with the corresponding branch; and a supply conduit in fluid communication with the inlet for supplying wash liquid to the liquid distribution header and wherein the supply conduit includes an off-center placement with respect to the liquid distribution header;

wherein each of the channels has a matching volumetric flow rate as that of the corresponding branch to minimize pressure loss from the inlet to the branches wherein the volumetric flow rate is a function of a volume of liquid which passes through a given cross-sectional area and a velocity of the liquid flowing there through.

2. The dishwasher of claim 1, further comprising a spray assembly provided within the treating chamber and emitting liquid to provide a spray within the treating chamber that forms a second spray zone directed toward the utensil zone.

3. The dishwasher of claim 1 wherein the interior flow path lacks sharp transitions between the multiple channels and the multiple branches.

4. The dishwasher of claim 3 wherein the interior flow path comprises curved transitions between the multiple channels and the multiple branches.

5. The dishwasher of claim 1 wherein a transition of the interior flow path comprises a rounded corner.

6. The dishwasher of claim 1 wherein the inlet of the interior flow path and an outlet of the interior flow path have equal cross-sectional areas.

7. The dishwasher of claim 1 wherein each branch supplies liquid to multiple apertures.

8. The dishwasher of claim 7 wherein the multiple apertures on at least one of the branches are positioned asymmetrically on the at least one of the branches.

9. The dishwasher of claim 7 wherein a volumetric flow rate requirement of a branch is approximately the sum of the volumetric flow rate requirement of the apertures provided thereby.

10. The dishwasher of claim 1 wherein the spray manifold includes multiple spray heads, each spray head having at least one aperture of the multiple apertures.

11. The dishwasher of claim 10 wherein the branches include differing numbers of spray heads.

12. The dishwasher of claim 11 wherein the multiple spray heads are identical to each other.

13. The dishwasher of claim 1 wherein the supply conduit is laterally off-center with respect to the liquid distribution header.

14. The dishwasher of claim 1 wherein the liquid distribution header further comprises a flow diverter configured to proportionally divide a cross-sectional area of an outlet opening of the supply conduit.

15. The dishwasher of claim 14 wherein the flow diverter comprises a deflector wall positioned in opposing relationship to the outlet opening of the supply conduit.

16. The dishwasher of claim 15 wherein the flow diverter further comprises a nose portion from which the deflector wall extends and where the nose is configured to divide the liquid supplied from the supply conduit into two separate flows.

* * * * *